US008480171B2

(12) United States Patent
Chadwick et al.

(10) Patent No.: US 8,480,171 B2
(45) Date of Patent: Jul. 9, 2013

(54) OFFICE CHAIR

(75) Inventors: Donald T. Chadwick, Los Angeles, CA (US); Arkady Golynsky, Allentown, PA (US); Robert A. Melhuish, East Greenville, PA (US); Hendrik R. van Hekken, Allentown, PA (US); Ron K. Watson, Flower Mound, TX (US)

(73) Assignee: Knoll, Inc., East Greenville, PA (US)

( * ) Notice: Subject to any disclaimer, the term of this patent is extended or adjusted under 35 U.S.C. 154(b) by 2134 days.

(21) Appl. No.: 11/178,051

(22) Filed: Jul. 8, 2005

(65) Prior Publication Data

US 2006/0006715 A1 Jan. 12, 2006

Related U.S. Application Data

(60) Provisional application No. 60/586,951, filed on Jul. 8, 2004.

(51) Int. Cl.
*A47C 1/24* (2006.01)
*A47C 7/46* (2006.01)

(52) U.S. Cl.
USPC ..... 297/300.4; 297/301.3; 297/301.5; 297/284.4

(58) Field of Classification Search
USPC ..... 297/301.3, 301.5, 300.4, 284.4
See application file for complete search history.

(56) References Cited

U.S. PATENT DOCUMENTS

| | | | | |
|---|---|---|---|---|
| 622,647 | A | 11/1900 | Howe | |
| 1,222,908 | A | 4/1917 | Turner | |
| 1,698,064 | A | 1/1929 | Otto | |
| 1,698,065 | A | 1/1929 | Otto | |
| 1,711,670 | A | 5/1929 | Brennan | |
| 3,386,770 | A * | 6/1968 | Williams | 297/301.3 |
| 3,552,796 | A * | 1/1971 | Williams | 297/301.3 |
| 3,915,775 | A | 10/1975 | Davis | |
| 3,934,216 | A * | 1/1976 | Ward | 335/272 |
| 4,299,645 | A | 11/1981 | Newsom | |
| 4,339,488 | A | 7/1982 | Brokmann | |
| 4,364,607 | A | 12/1982 | Tamburini | |
| 4,517,234 | A | 5/1985 | Fisher | |
| 4,522,444 | A | 6/1985 | Pollock | |
| 4,743,323 | A | 5/1988 | Hettinga | |

(Continued)

FOREIGN PATENT DOCUMENTS

| | | |
|---|---|---|
| NZ | 224570 | 8/1989 |
| NZ | 504871 | 4/2002 |

*Primary Examiner* — David Dunn
*Assistant Examiner* — Tania Abraham
(74) *Attorney, Agent, or Firm* — Buchanan Ingersoll & Rooney PC

(57) ABSTRACT

A chair having a seat rotatably attached to a tilt spring portion of a tilt mechanism such that the tilt spring is activated by movement of the seat. A backrest and/or the seat can be rotatably connected to the tilt mechanism by parallel arm arrangements which permit the seat and backrest to tilt relative to each other. A tilt limiter can have a magnetic member which facilitates full movement of the tilt limiter between free and locked positions, and which creates an audible indication of full movement of the tilt limiter. The seat/backrest can be made from a flexible mesh material secured to a rigid overmolding which surrounds and is attached to an inner frame of the seat/backrest wherein an outer surface of the overmolding forms an outer surface of the seat/backrest frame and attachment of the overmolding causes the inner frame to stretch the mesh to a final condition.

20 Claims, 22 Drawing Sheets

U.S. PATENT DOCUMENTS 4,869,554 A 9/1989 Abu-Isa et al.
5,015,034 A 5/1991 Kindig et al.
5,385,388 A * 1/1995 Faiks et al. ..... 297/301.3
5,445,436 A 8/1995 Kemnitz
5,464,274 A * 11/1995 Golynsky et al. ..... 297/328
5,518,292 A 5/1996 Cozzani
5,662,383 A 9/1997 Hand
5,716,101 A 2/1998 Frinier et al.
5,762,403 A 6/1998 Robinson
5,765,804 A 6/1998 Stumpf et al.
5,772,282 A 6/1998 Stumpf et al.
5,897,472 A * 4/1999 Thulasingam ..... 482/133
5,964,503 A * 10/1999 Inoue ..... 297/300.4
5,975,634 A * 11/1999 Knoblock et al. ..... 297/300.4
6,035,901 A 3/2000 Stumpf et al.
6,048,025 A 4/2000 Tillner
6,059,368 A 5/2000 Stumpf et al.
6,106,071 A * 8/2000 Aebischer et al. ..... 297/452.18
6,125,521 A 10/2000 Stumpf et al.
6,158,808 A * 12/2000 Margolis et al. ..... 297/330
6,354,662 B1 * 3/2002 Su ..... 297/284.7
6,386,634 B1 5/2002 Stumpf et al.
6,394,553 B1 5/2002 McAllister
6,419,318 B1 * 7/2002 Albright ..... 297/284.7
6,424,245 B1 * 7/2002 Rector et al. ..... 335/220
6,439,661 B1 * 8/2002 Brauning ..... 297/300.2
6,478,381 B1 11/2002 Cramb, III et al.
6,494,537 B1 * 12/2002 Lie ..... 297/300.4
6,511,562 B1 1/2003 Coffield
6,523,898 B1 * 2/2003 Ball et al. ..... 297/320
6,540,950 B1 4/2003 Coffield
6,560,827 B1 5/2003 Gross
6,572,190 B2 * 6/2003 Koepke et al. ..... 297/284.1
6,585,320 B2 * 7/2003 Holbrook et al. ..... 297/300.4
6,588,842 B2 7/2003 Stumpf et al.
6,702,390 B2 3/2004 Stumpf et al.
6,722,741 B2 4/2004 Stumpf et al.
6,726,286 B2 4/2004 Stumpf et al.
6,733,080 B2 5/2004 Stumpf et al.
6,824,218 B1 11/2004 van Hekken
6,945,602 B2 * 9/2005 Fookes et al. ..... 297/300.4
7,026,940 B2 * 4/2006 Cherubini ..... 340/573.1
7,097,249 B2 * 8/2006 Igarashi et al. ..... 297/323
7,159,943 B2 * 1/2007 Costaglia ..... 297/323
7,165,811 B2 * 1/2007 Bodnar et al. ..... 297/300.2
2003/0001420 A1 * 1/2003 Koepke et al. ..... 297/440.15
2003/0034682 A1 2/2003 Stumpf
2004/0155503 A1 8/2004 Stumpf et al.
2005/0179295 A1 * 8/2005 Catanzarite et al. ..... 297/354.1

* cited by examiner

OFFICE CHAIR

CROSS REFERENCE TO RELATED APPLICATION

This application claims priority to U.S. Provisional Patent Application Ser. No. 60/586,951, filed Jul. 8, 2004.

BACKGROUND OF THE INVENTION

1. Field of the invention

The present invention relates to an office chair, and more particularly to a molded office chair frame having a mesh fabric support.

2. Description of the Prior Art

There are a variety of office and task chairs available on the market, many of which have tilt control mechanisms. The purpose of the design is to provide a comfortable and ergonomic seating arrangement for the user that allows the user to sit in a variety of positions while providing the necessary support and comfort for the user, regardless of the user's height, weight or other physical characteristics.

Generally, an office or task chair has a base, typically mounted on casters or fixed slides that rest on the floor, and has attached thereto a support column supporting the seat of the chair thereon. Mounted to the support column and between the seat and back of the chair is a tilt control housing, which contains the various controls, knobs and mechanisms for adjusting the height of the chair, the tilt of the chair and various other adjustments so that the user can personalize the chair to his or her own use. The chair may or may not include armrests, which may also be fixed or adjustable in a variety of positions. While there are many mechanisms for controlling the tilt of an office chair, such control mechanisms are generally operated by a spring that is operatively connected to the backrest and driven or activated by movement of the backrest. While the spring can be of any type of construction, such as leaf spring, coil spring, or the like, the tilt of the chair is generally controlled by the user's weight pressing on the back portion of the chair. The chair is generally biased toward an upright condition, such that the user must exert considerable pressure to tilt the backrest to a reclining position. While the amount and ease of tilt may be controlled by adjusting the spring tension, as soon as the user moves forward, the backrest often moves forward thus pushing against the back of the user. Hence, the user feels pressure against his or her back as they recline in the chair, generally giving the feeling that the user is being pushed from the chair.

It is also preferable for the chair to have a lumbar support, which is also adjustable according to the shape or height of the user. There are a variety of lumbar supports available, but most are permanently attached to the chair. Preferably, the lumbar support is easily detachable from the chair such that it can be removed if the user does not desire to have such a support on the backrest. The lumbar support can be attached to either the front or the back of the chair, or can be hidden within the upholstery of the chair. However, when no upholstery is provided it is preferable that the lumbar support have an infinite adjustment on the face of the fabric, which may include mesh fabric, from the lumbar to the pelvic region of the users body.

It is also desired that the armrests be adjustable so that the chair can accommodate a user of any height. While many chairs provide adjustable armrests, the armrests should tilt proportionately to the seat and backrest so that the user remains comfortable at any position of the chair and the user's arms remain level to the floor.

Finally, the fabric of the chair should provide for adequate support for the user's weight, as well as allowing for sufficient airflow around the chair and the user's body to make the user as comfortable as possible. While it is common to use an upholstery covering with a foam interior for comfort and support, an open weave fabric can allow for increased air circulation around the user. The open weave, or mesh, fabric must be sufficiently taut to comfortably support he user's weight, while comfortably conforming to each user's unique body shape.

What is needed then, is a fully adjustable office or task chair that is more accommodating to the user when the user wants to recline and does not try to force the user back into an upright position.

It is therefore an object of the present invention to provide an office or task chair that is adjustable and reclines in a more controlled manner according to the wishes of the user. It is a further object of the present invention to provide an adjustable office chair that reclines as a function of the weight of the user, rather than with the pressure the user exerts on the backrest.

It is a still further object of the present invention to provide an office chair that has full adaptability for any particular user.

BRIEF DESCRIPTION OF THE DRAWINGS

Various other objects, features and advantages of the present invention will become readily apparent by reading the following description in conjunction with the drawings, which are shown by way of example only, wherein.

DETAILED DESCRIPTION OF CERTAIN EMBODIMENTS

Figure 1:
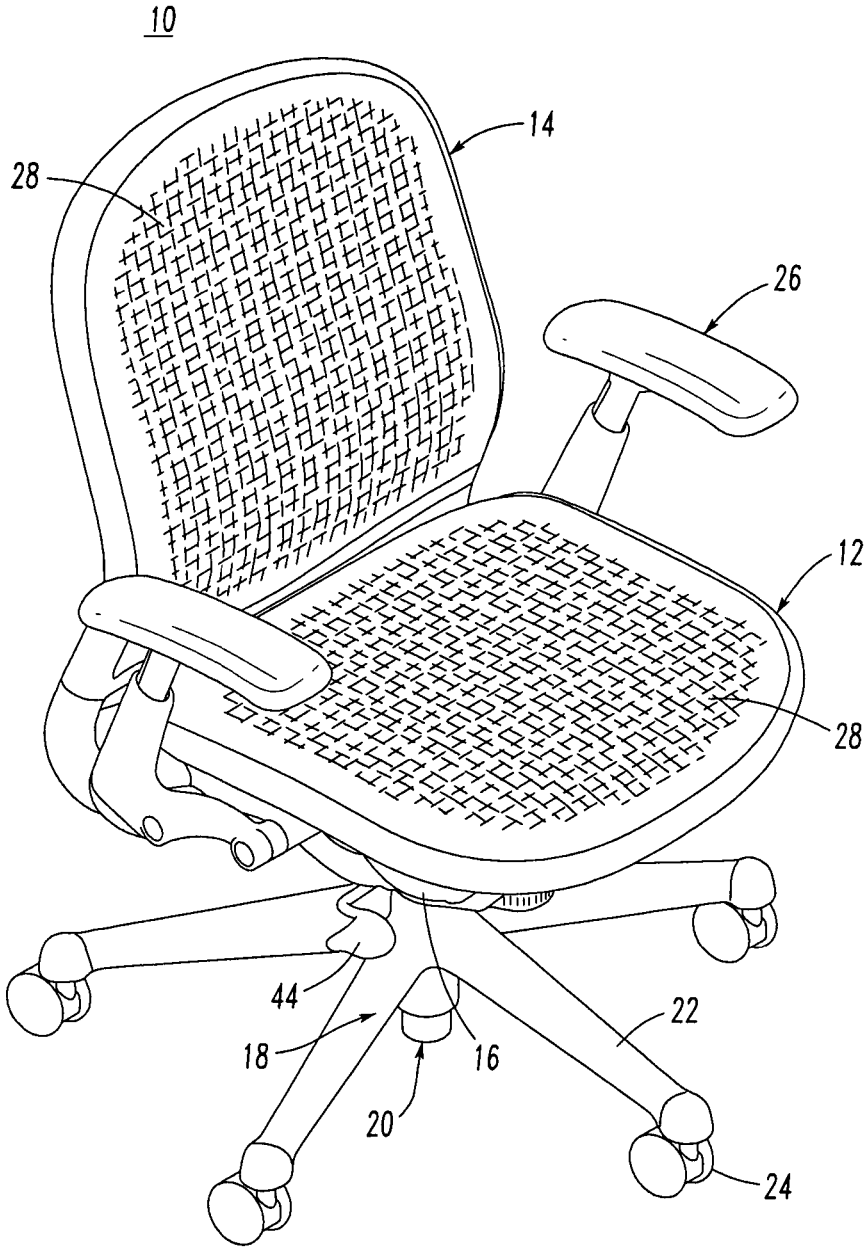
FIG. 1 is an isometric view of an office chair according to an embodiment of the invention.
Figure 2:
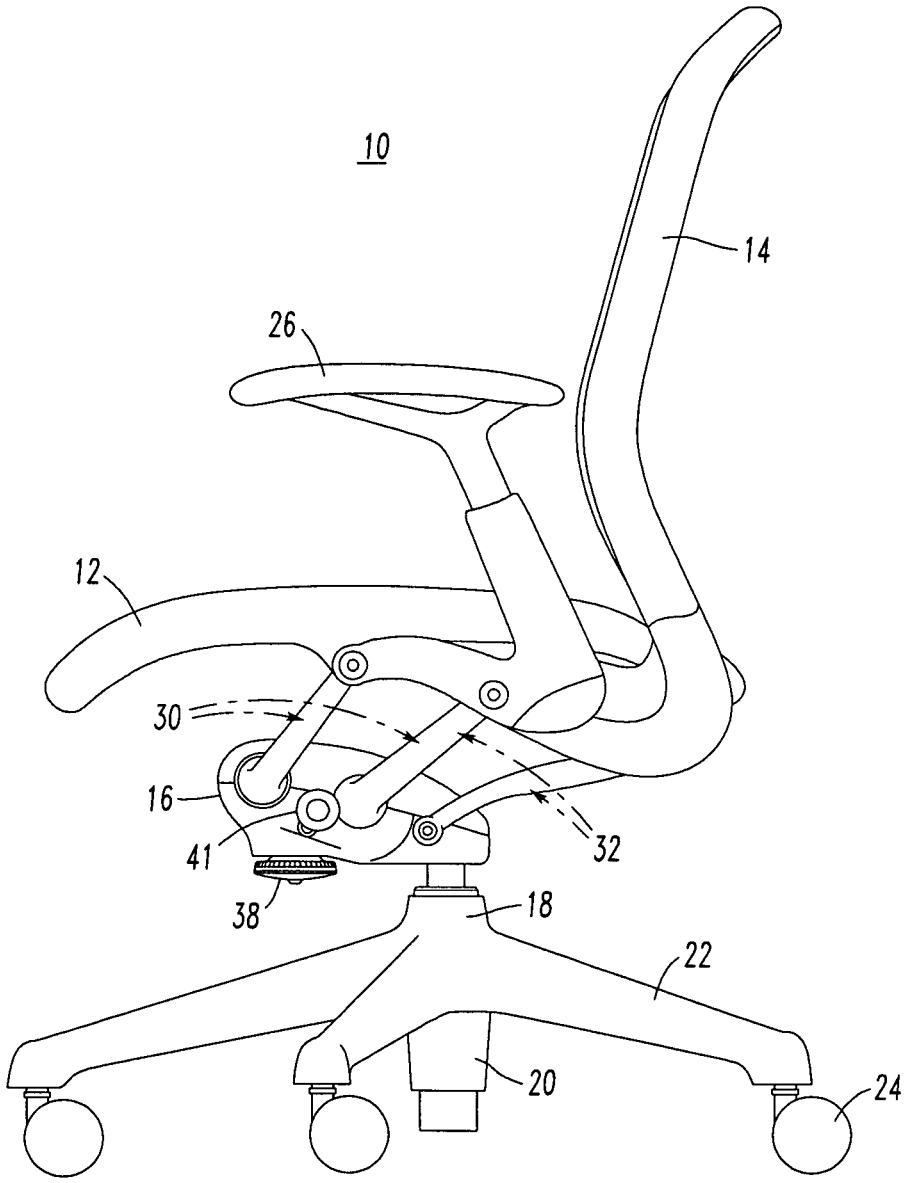
FIG. 2 is a left side view of the office chair shown in FIG. 1.
Figure 3:
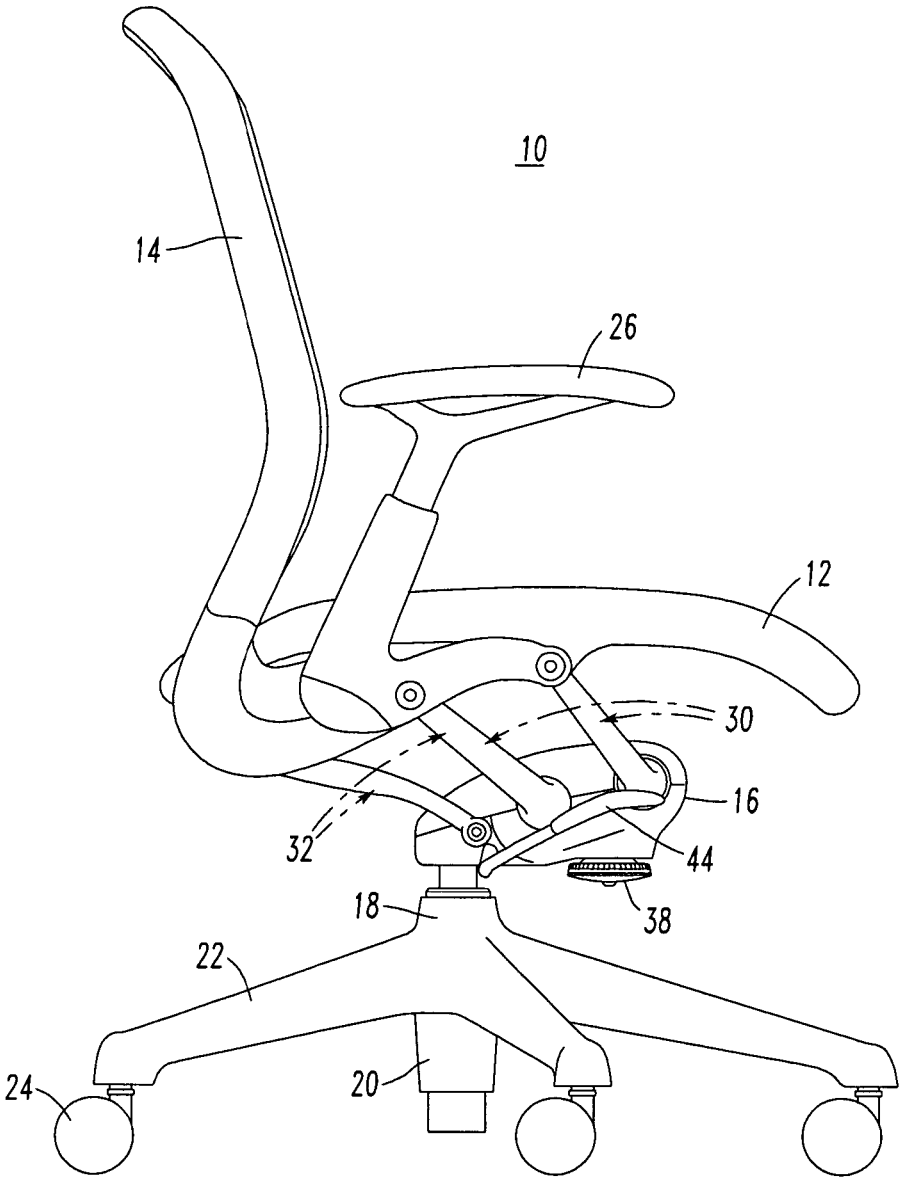
FIG. 3 is a right side view of the office chair shown in FIG. 1.
Figure 4:
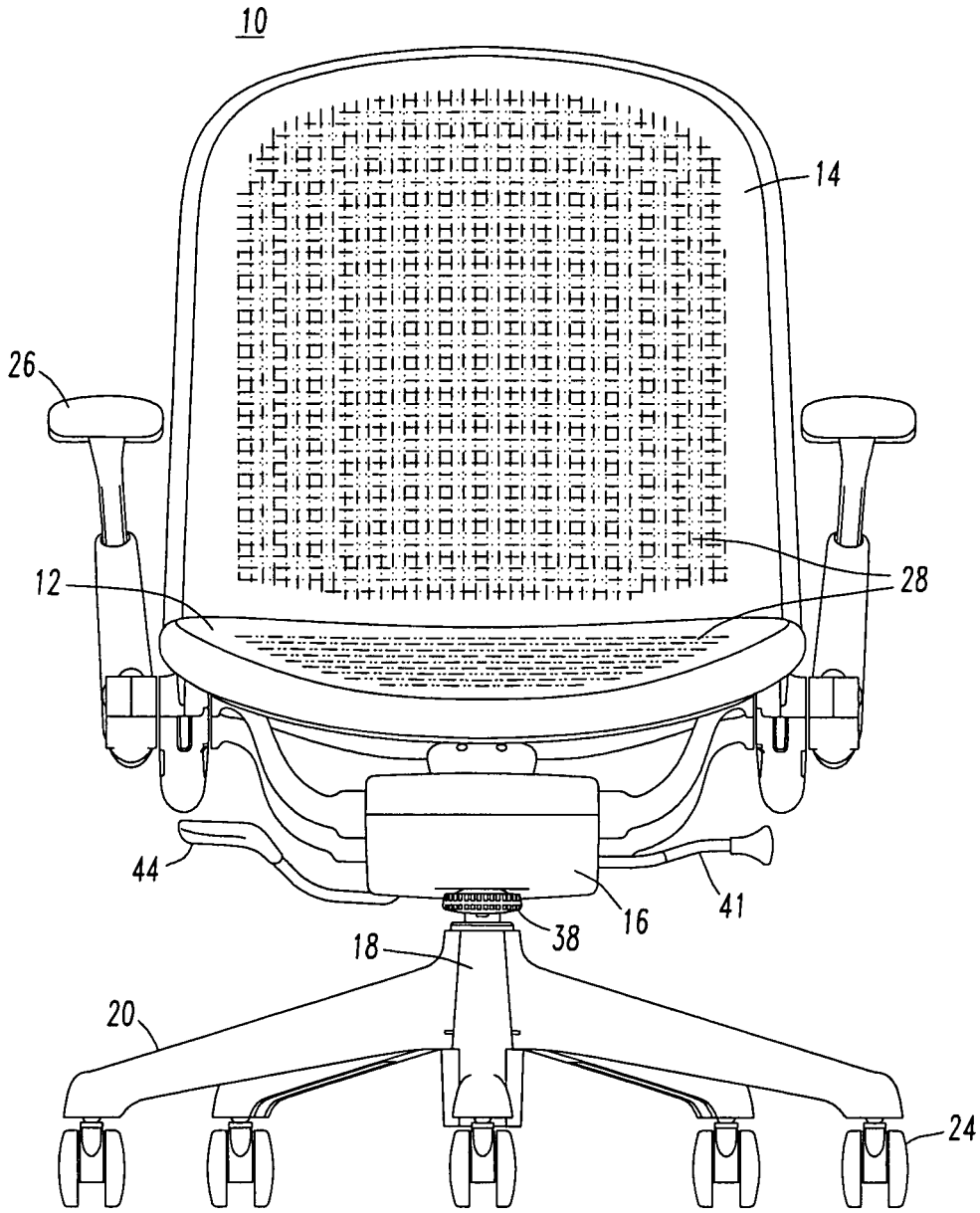
FIG. 4 is a front view of the office chair shown in FIG. 1.
Figure 5:
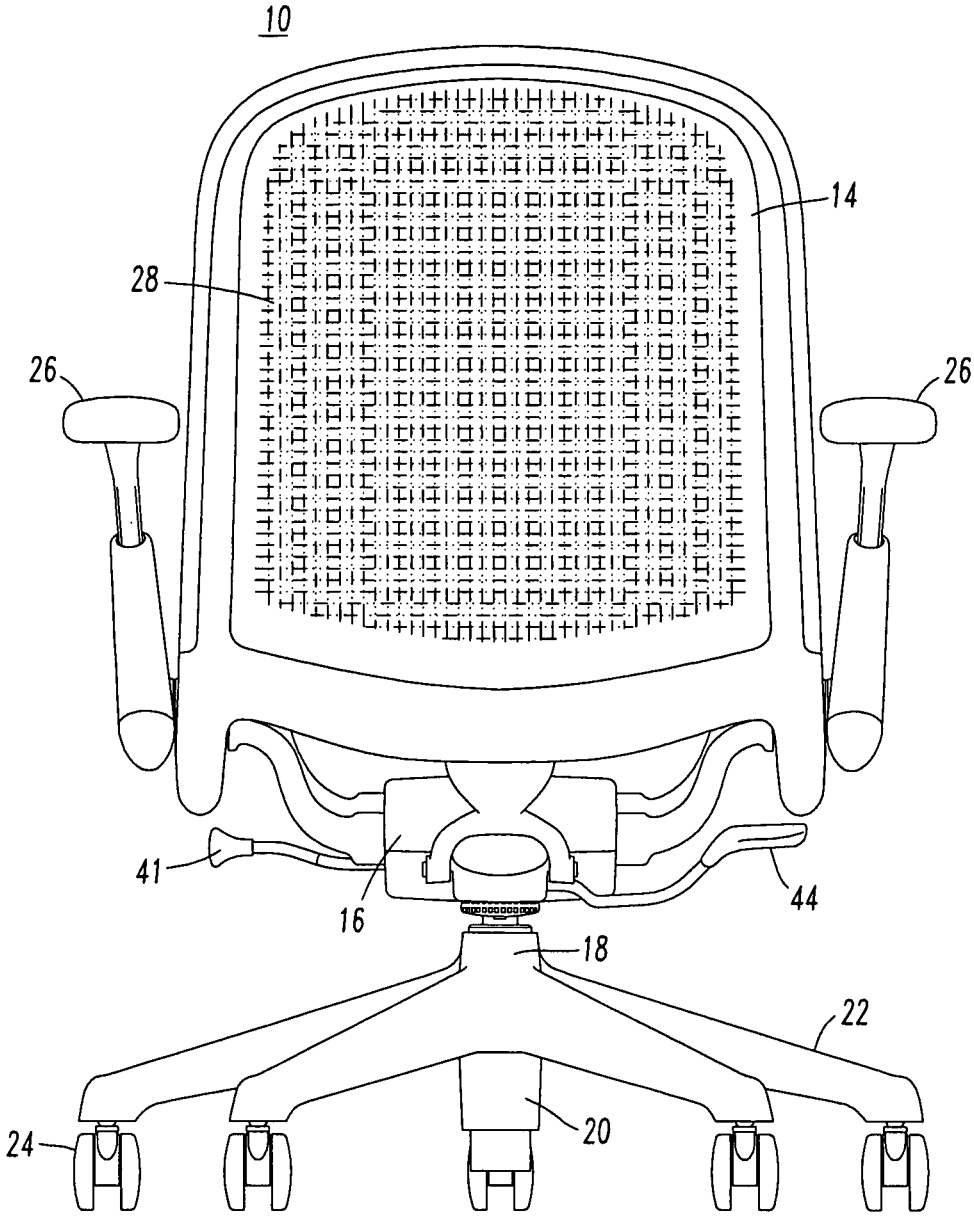
FIG. 5 is a rear view of the office chair shown in FIG. 1.
Figure 6:
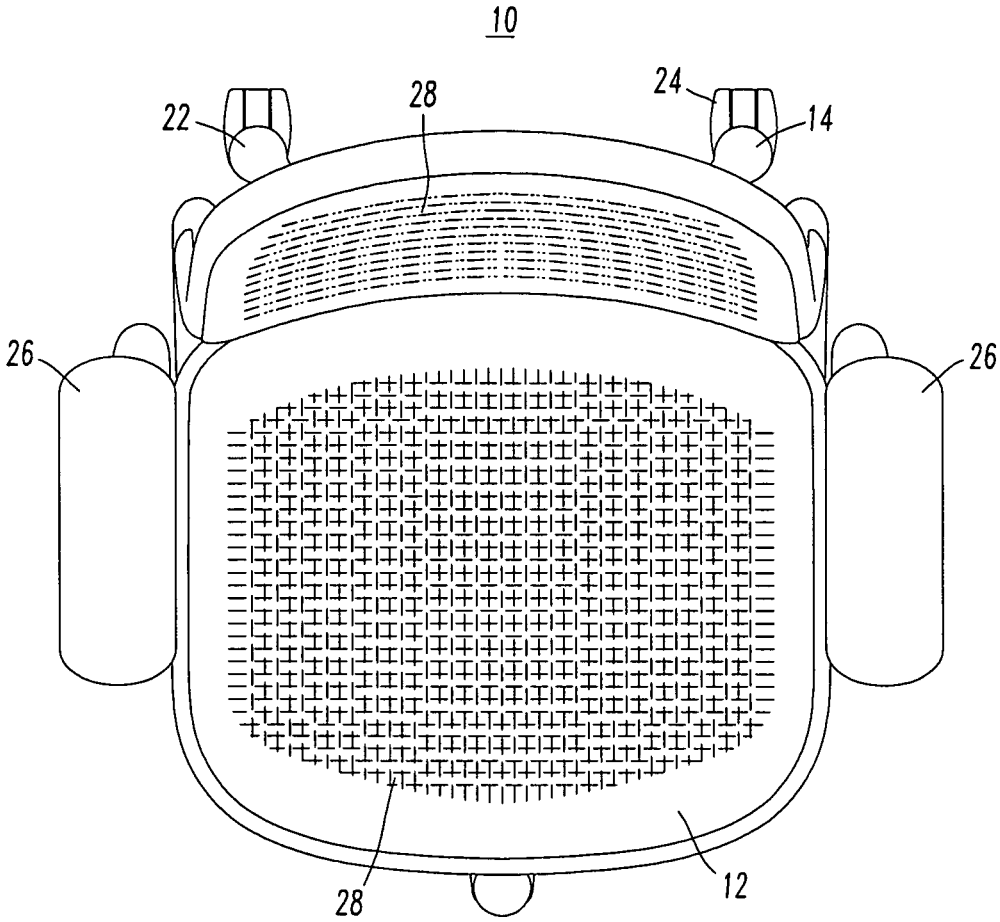
FIG. 6 is a top view of the office chair shown in FIG. 1.
Figure 7:
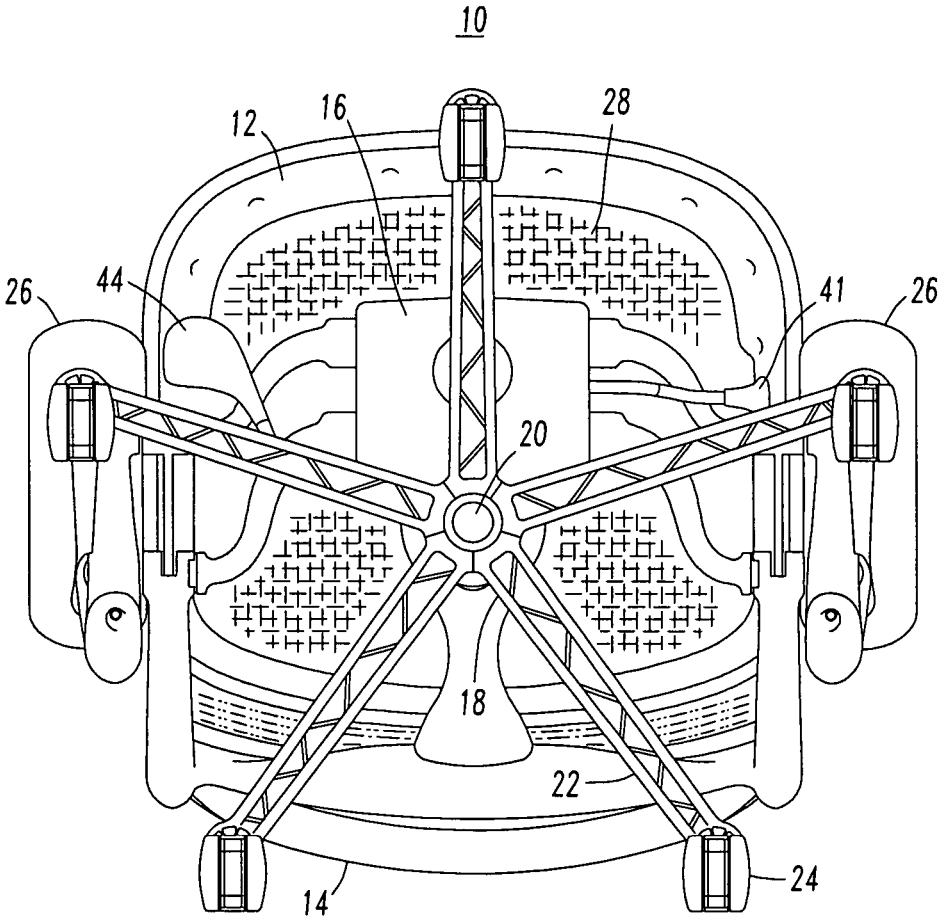
FIG. 7 is a bottom view of the office chair shown in FIG. 1.

Referring now to the drawings in detail, wherein like reference characters refer to like elements, there is shown in FIGS. 1-8 an embodiment of an adjustable chair, such as an office or task chair, according to the invention. FIGS. 1-7 show the chair 10 in an isometric view (FIG. 1) and in views in right side, left side, front, rear, top and bottom views (FIGS. 2-7, respectively). As best seen in the exploded view presented in FIG. 8, the chair 10 generally comprises a seat 12 and backrest 14 operatively mounted to a tilt control housing 16 by parallel arm arrangements, and wherein the tilt control housing 16 is attached to a base 18 via a vertical support column 20. The base 18 preferably comprises a plurality of radially outward extending legs 22, for example five, which are preferably provided with casters 24 to enable easily moving the chair 10 around on a work surface. Alternatively, fixed glides (not shown) may be provided instead of casters.

Preferably, the vertical support column 20 is height adjustable, in a manner well known in the art, and a pair of adjustable armrests 26 are also preferably included. The armrests 26 can be like the adjustable armrest described in applicant's U.S. patent application Ser. No. 10/769,061, which issued as U.S. Pat. No. 6,824,218 on Nov. 30, 2004, which is discussed more hereinafter. Alternatively, the chair 10 need not have armrests 26.

The seat 12 and backrest 14 can each preferably be made from a resiliently flexible mesh material. Both the seat 12 and the backrest 14 can be rotatably attached to the tilt control housing 16 by parallel arm arrangements 30, 32 such that the seat 12 and/or backrest 14 can tilt relative to the tilt mechanism and/or each other, as will be explained in more detail hereinafter in connection with the drawing figures.

Figure 9:
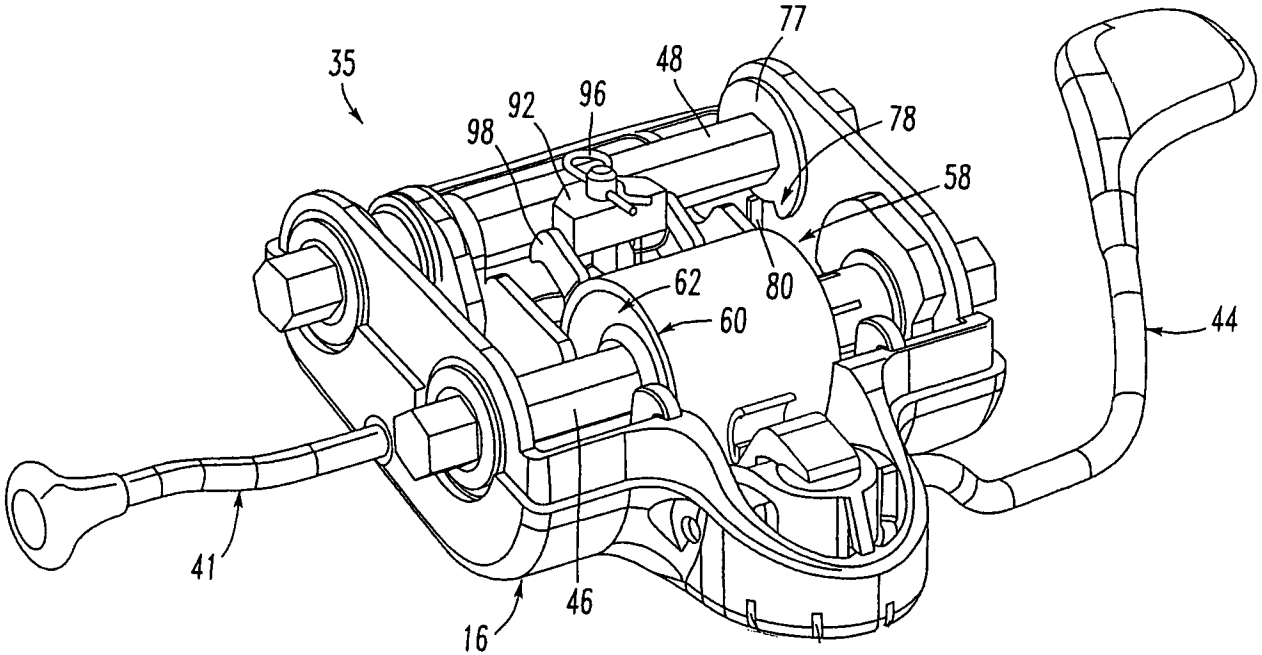
FIG. 9 is an isometric view of the housing and tilt mechanism, with the cover removed, for an office chair such as shown in FIG. 1.
Figure 10:
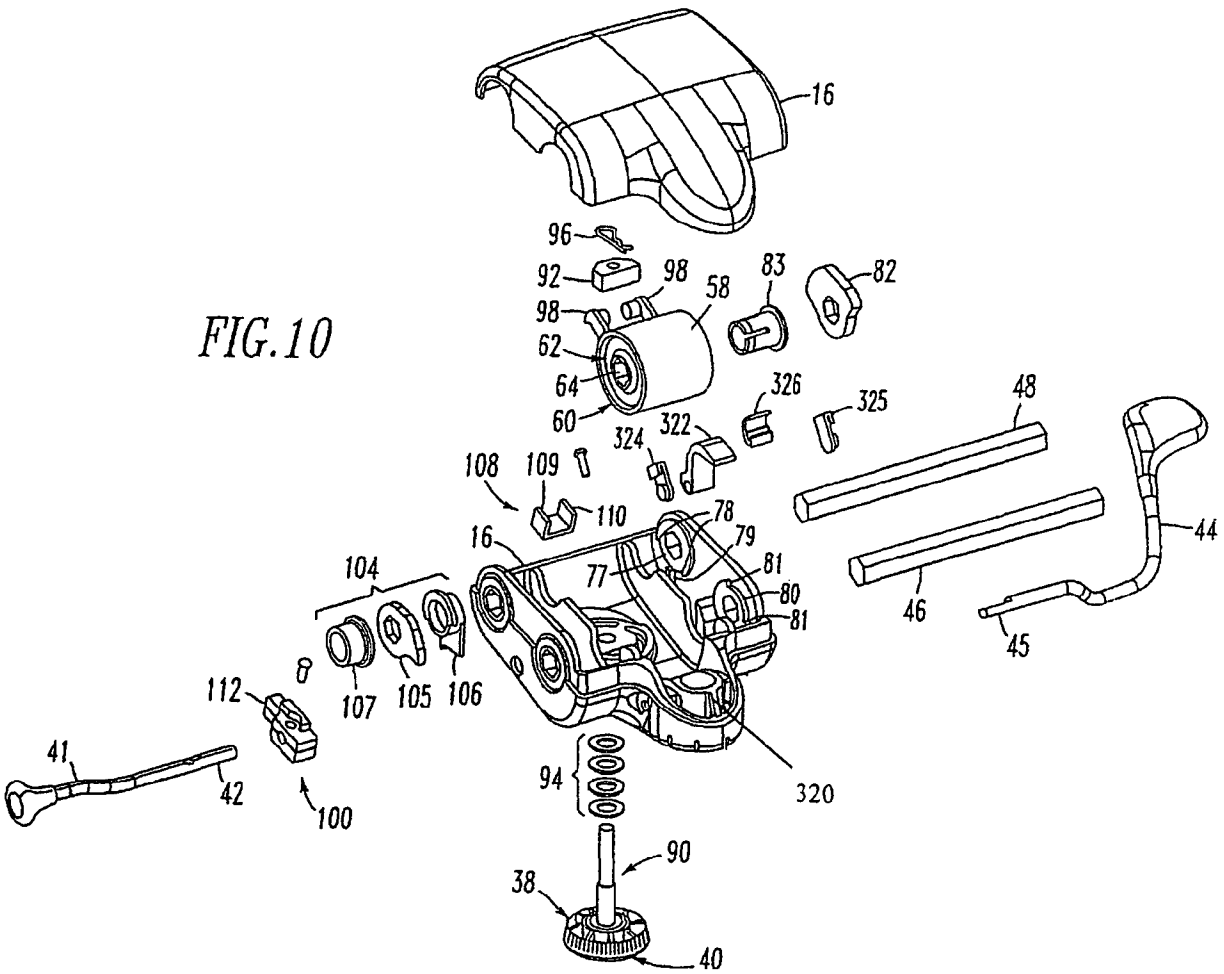
FIG. 10 is an exploded view of an embodiment of a housing and tilt mechanism as shown in FIG. 9.

As shown best in FIGS. 9 and 10, tilt control housing 16 encloses a tilt control mechanism 35, and also includes various knobs and handles for providing the various adjustments to the chair 10 to permit a user to customize the chair 10 to provide a comfortable sitting position. For example, the tilt control housing 16 can comprise the enclosed tilt control mechanism 35, a tilt rate adjustment knob 38, a tilt lever 41, and a seat height adjustment lever 44.

A presently preferred embodiment of the tilt control mechanism 35 comprises first 46 and second 48 rotatable shafts, which are preferably hexagonal shaped, and which are connected to first 52 and second 54 pairs of parallel links which rotatably connect opposite sides of the seat 12 to the tilt control mechanism. These first 52 and second 54 pairs of parallel links comprise the first pair 30 of the two pairs of parallel arm arrangements 30, 32 referenced in FIGS. 2 and 3. The seat 12 is connected to the parallel links 52, 54 via seat brackets 61, which can be integrally molded on an underside of an inner frame of the seat 12, which is described in more detail hereinafter. To provide a secure engagement of the parallel links to the seat 12, sleeves 53 and compression bushings 55 can be utilized along with screws 57 to rigidly, yet rotatably, connect the parallel links 52, 54 to the seat brackets 61. The sleeves 53 and compression bushings 55 permit the screws 57 to be tightened sufficiently while preventing any binding which may otherwise occur between the ends of the parallel links 52, 54 and the seat brackets 61, thus permitting the ends of the parallel links 52, 54 to rotate freely relative to the seat brackets 61.

The tilt control mechanism 35 includes a torsionally activated tilt spring 58 associated with one of the rotatable shafts 46, 48, and preferably the rear-most shaft 46, which is hereinafter referred to as the drive shaft 46. The second, front-most shaft 48 is referred to as the "follower" shaft 48. Activating the tilt spring 58 from the rearward located drive shaft 46 enables a relatively small moment arm, which is the effective distance between the connection point of the rear pair of parallel arms to the seat 12 and the connection to the drive shaft 46. This relatively small moment arm enables a smaller, lower rate tilt spring 58 to be utilized, in comparison to tilt springs in conventional tilt control mechanisms. The tilt spring 58 can be a conventional torsionally activated spring comprising a rigid outer cylindrical surface 60 that is adhered, e.g., glued, to a cylindrical inner resilient spring element 62. A bore 64, preferably having a hexagonal shape to match the hexagonal shaped drive shaft 46, is provided through the center of the inner resilient spring element 62. The hexagonal shaped drive shaft 46 is disposed through this bore 64 such that rotation of the drive shaft 46 rotates an inner portion of the resilient spring element 62. Since an outer portion of the resilient spring element 62 is fixed, via attachment to the rigid outer surface 60, rotation of the inner portion creates a torsional force in the resilient spring element 62, which provides the resistance to the tilting of the seat 12 and backrest 14.

Figure 11:
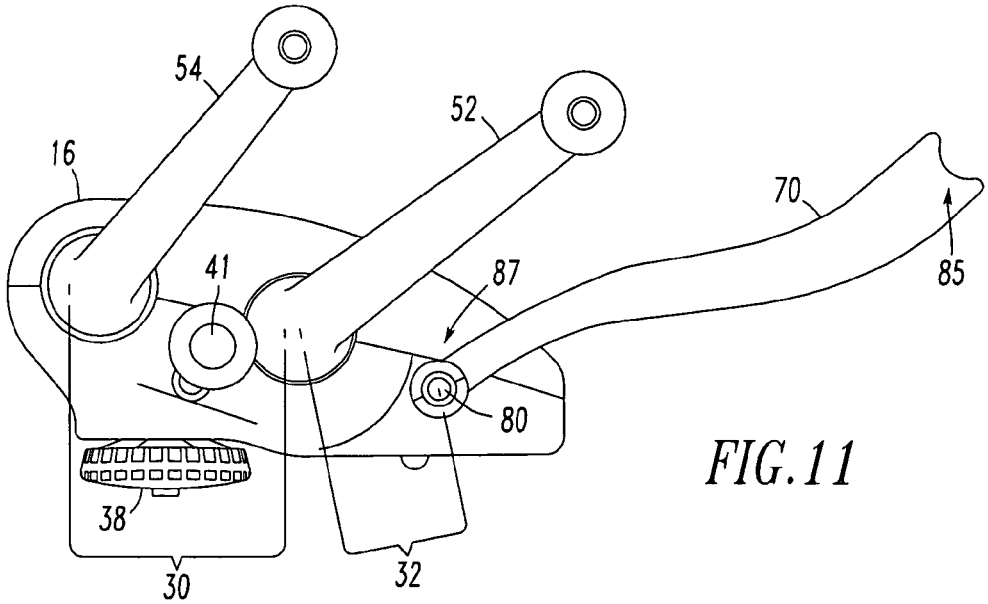
FIG. 11 is a side view of an embodiment of a linkage mechanism by which the tilt mechanism and housing is attached to the seat and backrest of an office chair such as shown in FIG. 1, with the linkages shown in a fully upright position of the chair.
Figure 12:
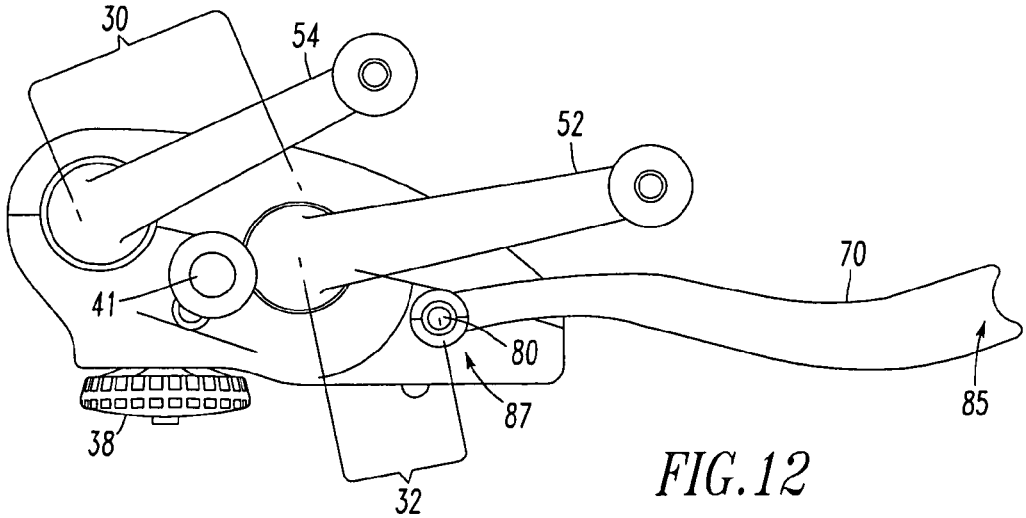
FIG. 12 is a side view of the same linkages as shown in FIG. 11, except shown in a fully reclined position for the chair.

Referring now to FIGS. 11 and 12, the side views therein illustrate the parallel arm arrangements 30, 32 which connect the seat 12 to the tilt control housing 16, in fully raised (upright) and fully lowered (reclined) positions, respectively. As shown in these and various other figures, tilting of the seat 12 and backrest 14 is accomplished by a plurality of parallel links 52, 54, and 70, which form the aforesaid parallel arm arrangements 30, 32, and which rotatably connect both the seat 12 and the backrest 14 to the tilt control housing 16. Preferably, the seat 12 is attached to the tilt control housing 16 by a first two pairs 52, 54 of these links, which comprise a first pair 54 of follower links secured toward the front of the chair 10 and second pair of drive links 52 operatively connected between the tilt control housing 16 and a rearward portion of the chair 10. Each pair of links is comprised of (parallel) links attached on opposite sides of the tilt control housing 16 and seat. The drive links 52 connect the seat 12 to the tilt spring 58, as will be described in more detail hereinafter. As shown best in FIG. 8, a single Y-shaped link 70 connects a lower middle portion of the backrest 14 to the tilt control housing, and the sides of the backrest 14 are rotatably connected to the rear-most seat bracket 61 attachment point at which the drive links 52 are also attached.

The tilt spring 58 controls the rate of tilt of the seat 12, and the backrest 14. One end of each of the drive links 52 is operatively secured to the tilt control housing 16 while the second end of each is pivotally mounted to the seat bracket 61.

Additional details of the tilt control mechanism 35 are shown best in FIGS. 9-10, which show that the ends of both the follower 54 and drive links 52 are rotatably connected to the seat brackets 61, and the opposite ends thereof are connected to the follower 48 and drive 46 shafts that pass between opposite sides of the tilt control housing 16. Preferably both the follower 48 and drive 46 shafts are hexagonal-shaped rods, which facilitates a rigid connection to the links 52, 52 while permitting rotation thereof within the tilt control housing 16. The hexagonal shaped drive shaft 46 also facilitates activation of the tilt spring 58, as it mates with the hexagonal bore 64 provided through the center of the resilient spring member 62.

Although the hexagonal shafts 46, 48 could be attached to the housing in any particular order, in the preferred embodiment shown, the drive shaft 46 is mounted towards the rear of the seat 12 and the follower shaft 48 is located towards the front of the seat 12. The follower shaft 48 freely rotates with respect to the housing and is attached thereto by a rotating washer and includes a stop mechanism. The stop mechanism can comprises a washer 77 that is secured to and rotates with the follower shaft 48. The washer 77 can have a shoulders 78 which engage a ledge 79 provided on the inside of the tilt control housing 16. This stop mechanism is not intended to act as a tilt control stop, but is provided to facilitate assembly of the tilt control mechanism 35. The drive shaft 46 can also have a similar stop mechanism, using a similar washer 80 with shoulders 81. However, the shoulders 81 can instead cooperate with a separate stop member 82 which is inserted over the drive shaft 46 and is held in position at the edge of the tilt control housing 16 using a spacer 83. This stop mechanism is a full travel stop which blocks further rotation of the drive shaft 46 at a point at which full travel of the tilt mechanism 35 has been reached.

The drive shaft 46 is secured to, and also passes through, the tilt control housing 16 and is operatively engaged with the tilt spring, which is positioned towards the rear of the tilt control housing 16, as illustrated, in order to shorten the moment arm as much as possible. The drive shaft 46 also has a stop mechanism that engages a ledge provided on the inside of the tilt control housing 16 and acts as one of the stops, or limits, for the tilt control mechanism 35. The tilt spring 58 controls the rate and amount of tilt of the seat 12 and backrest 14. As the drive links 52 rotate, such as when a person sits on the seat, the drive shaft 46 is rotated thereby, which creates a torsional load on the tilt spring 58 by causing the resilient spring member 62 to rotate relative to the rigid outer cylindrical surface 60, which is secured to the inside of the tilt control housing 16 in a manner to generally prevent rotation thereof. When the force causing rotation of the drive shaft 46 is removed, as when the user gets up out of the chair 10, the tilt spring 58 will "unwind," returning the drive links 52, and thus the seat 12 (and backrest) to the initial upright position as the tilt spring 58 returns to the initial state.

Figure 8:
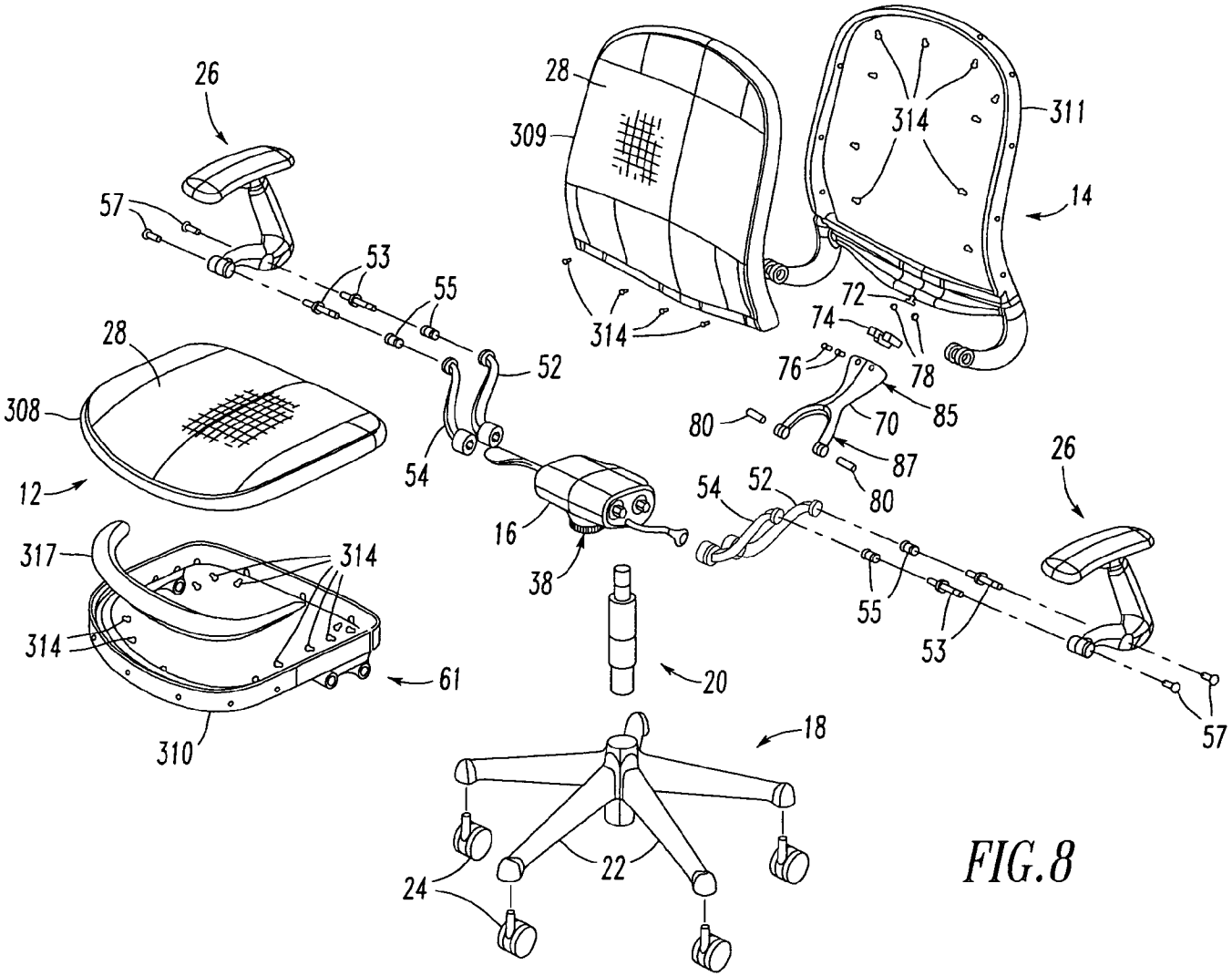
FIG. 8 is an exploded view of an embodiment of the office chair such as shown in FIG. 1.

As shown in FIGS. 8 and 11-12, the backrest 14 is connected to the seat 12 via a common connection point with the drive links 52 which connect the seat 12 to the tilt control housing 16. The backrest 14 is also rotatably connected to the tilt control housing 16 via the Y-shaped link 70 described above, which along with the drive links 52 forms the second parallel arm arrangement 32 between the seat 12/backrest 14 and the tilt control housing 16. The single prong end 85 of the Y-shaped link 70 is pivotably connected to the backrest, such as, for example, using a T-shaped projection 72 embedded in the lower middle portion of the backrest 14 which cooperates with a receiver 74 embedded or otherwise set within the end 85 of the Y-shaped link 70. The receiver 74 can have a T-shaped opening in which to pivotably receive the T-shaped projection 72. The receiver can be secured in a the end of the Y-shaped link 70 using, for example fasteners 76, and resilient members 78 can be associated with the end of the T-shaped projection 72 to facilitate pivoting of the T-shaped member 72 in the T-shaped opening in the receiver 74. In this manner, the backrest 14 can pivot sufficiently relative to the end 85 of the Y-shaped link 70 as the backrest 14 tilts.

The opposite, dual pronged end 87 of the Y-shaped link 70 is rotatably attached at two points to a rear-most portion of the tilt control housing 16. Each prong of the dual pronged end 87 of the Y-shaped link 70 is attached at an opposite side of a rear-most portion of the tilt control housing 16, such as using screws 80, or other fasteners which provide a rotatable connection.

The parallel arm arrangements 30, 32 which connect the seat 12 and the backrest 14 to the tilt control housing 16 thus permit rotation, e.g., titling, of the seat 12 and the backrest 14 relative to both the tilt mechanism 35 and to each other. In this manner, the degree of titling of the seat 12 can be varied from the degree of tilting of the backrest 14. Preferably, when the parallel arm arrangements 30, 32 are in the full upright position, as shown in FIG. 11, the seat 12 and/or backrest 14 are both canted slightly forwards. As a person sits down, the seat 12 and backrest 14 move back and downwards, according to the weight of the person, to a position at which the seat 12 and backrest 14 are generally level, or tilted slightly back. As the user leans back, placing more weight against the backrest 14, the seat 12 and backrest 14 will further tilt to a fully tilted position, corresponding to the position illustrated in FIG. 12. The Y-shaped link 70 helps support the backrest 14 and also assists the backrest 14 to recline in a controlled manner with respect to the seat 12.

Figure 13:
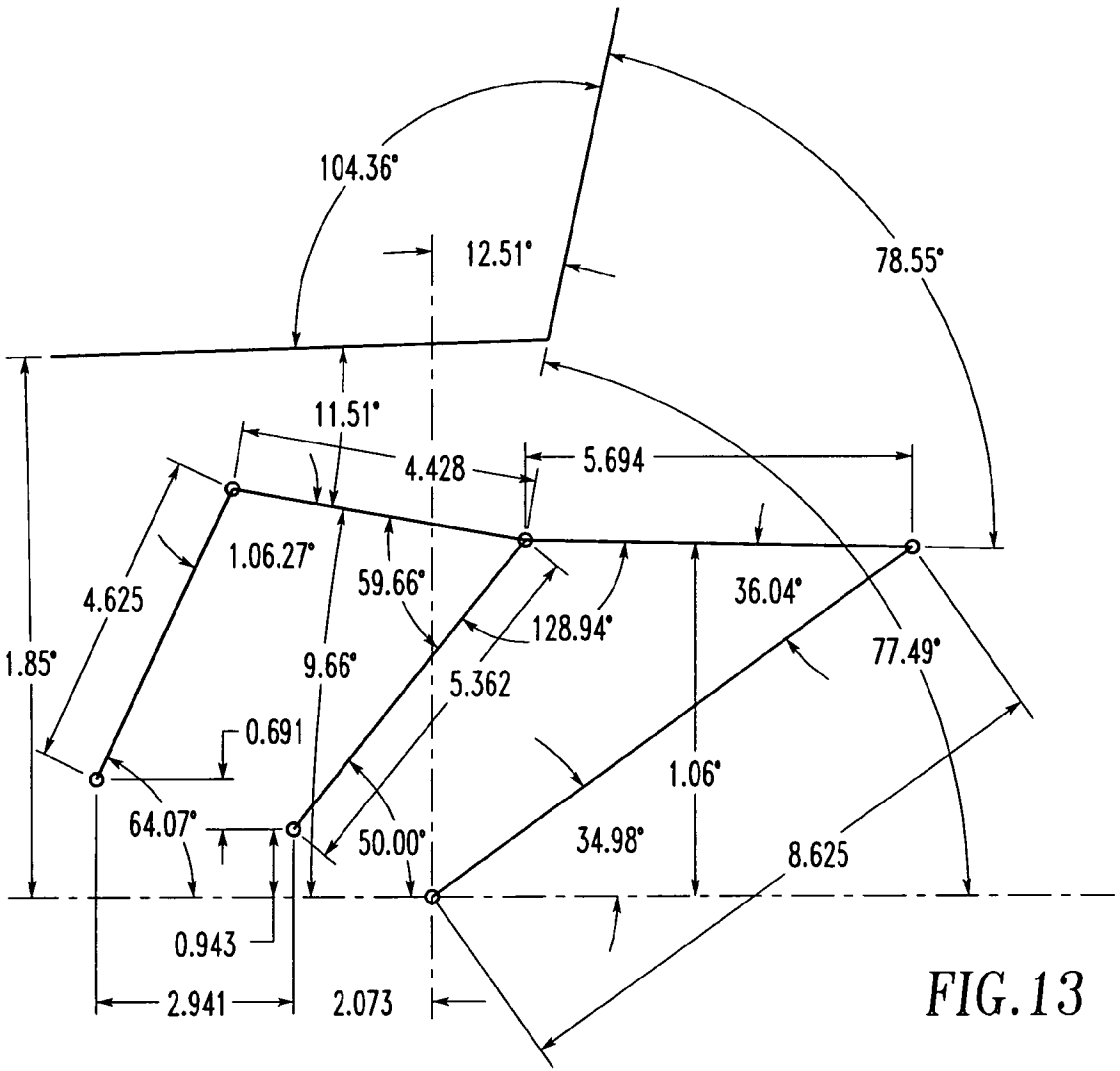
FIGS. 13 through 15 are kinematic diagrams for an embodiment of a parallel arm arrangement which connects the tilt mechanism to the chair seat and backrest.
Figure 14:
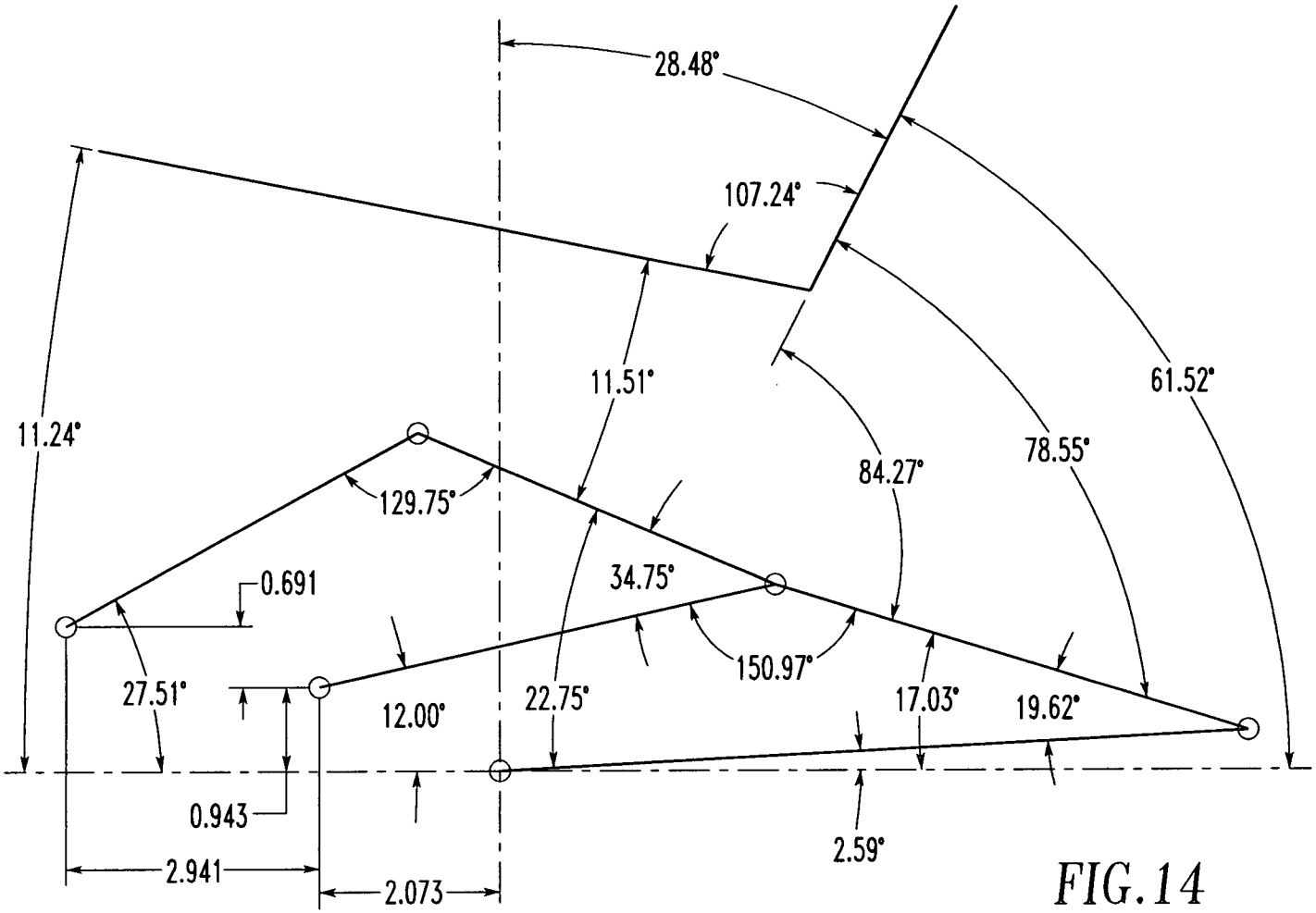
Figure 15:
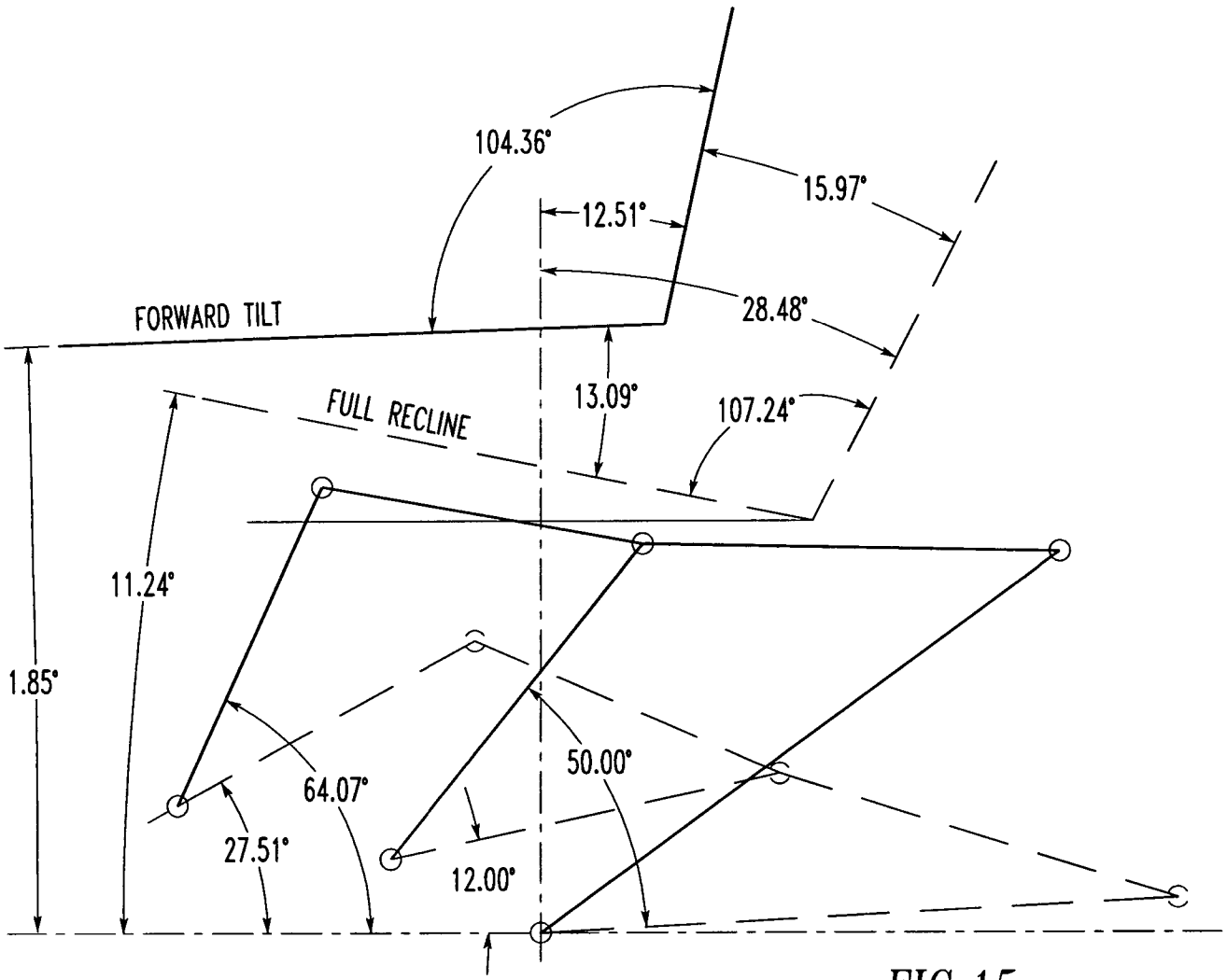
Figure 16:
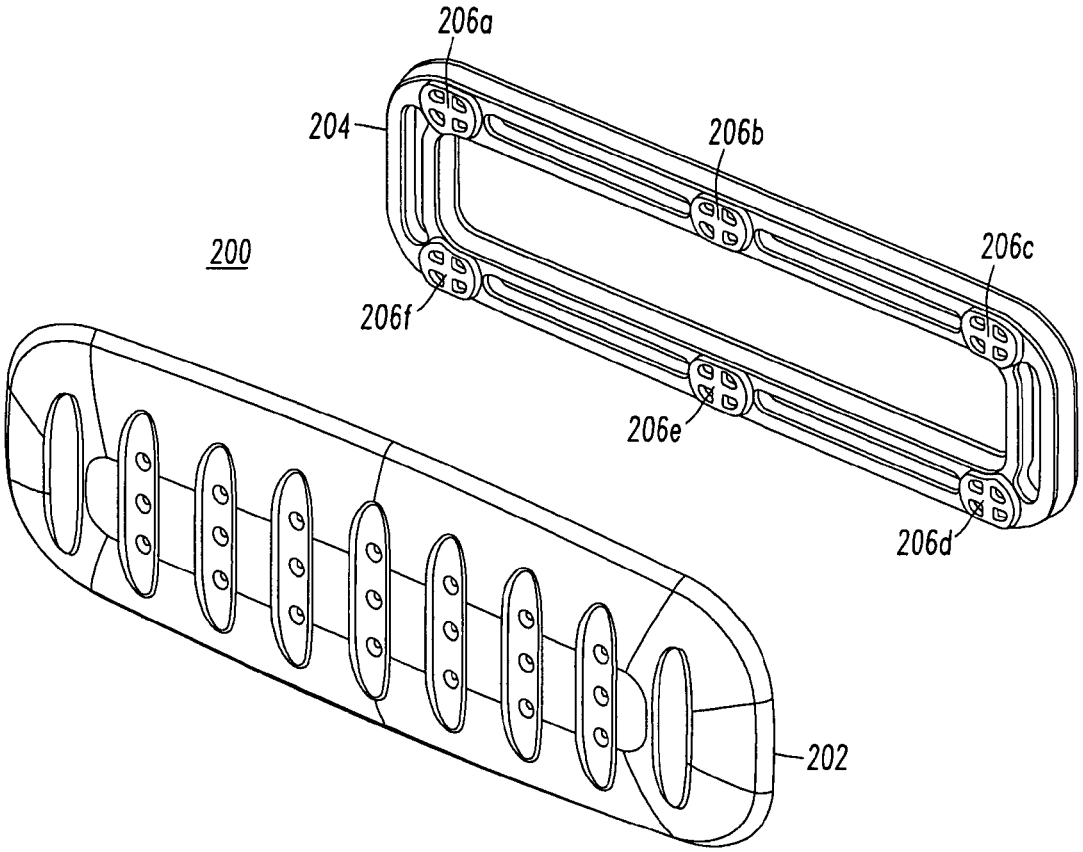
FIG. 16 is an isometric view of a preferred embodiment of a lumbar support for an office chair such as shown in FIG. 1.
Figure 17:
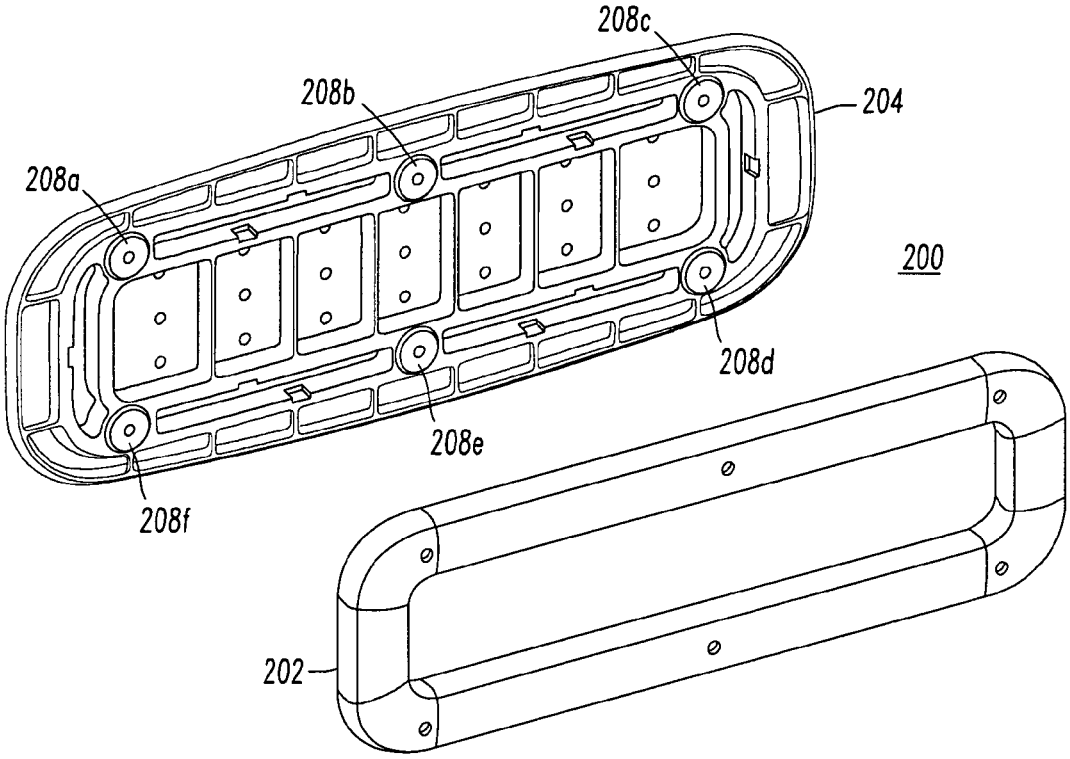
FIG. 17 is an isometric view showing an opposite side of a lumbar support illustrated in FIG. 16.

Referring to FIGS. 13-15, the parallel links 52, 54, Y-shaped link 70, seat 12 and backrest 14 are shown using kinematic diagrams in connection with the tilt control housing 16. The chair 10 is shown in a fully upright position in FIG. 13, a fully reclined position in FIG. 14, and with both positions shown together in FIG. 15. Development and testing of the invention resulted in a presently preferred embodiment of the parallel arm arrangements 30, 32 having the dimensions, and angles, presented in FIGS. 13-15, in which tilting of the seat 12 and backrest 14 occurs in a desired manner, as described herein.

In the upright, at rest position, it appears that the chair 10 may be level. Preferably however, the seat 12 is actually tilted somewhat forward, for example, at approximately 3 degrees of forward tilt. Thus, when viewing the chair 10 with no one seated thereon, the seat 12 generally tilts slightly forward. Although this appears to be counter-intuitive, it has been determined that with the link design of the present invention, as soon as someone sits in the chair, the chair 10 assumes a level or slightly rearward tilt according to the weight of the person seated. As described previously, as the user leans against the backrest 14 to further tilt the chair 10, the parallel arm arrangements 30, 32 are designed to slightly "open up" as the chair 10 tilts back. This is desired so as to prevent the seat 12 and backrest 14 from "closing together," i.e., a "clam shell" effect, in which the backrest 14 pushes on the back of the user, resulting in an uncomfortable sensation.

Since the drive links 52 and the follower links 54 are operatively connected between the tilt control housing 16 and the seat 12 rather than to the backrest 14, as is the conventional design, the recline of the chair 10 according to the invention is more directly keyed to the weight placed on the seat 12. That is, the tilt of the chair 10 is controlled more by the weight of the user and less by the force applied by the user against the backrest 14 of the chair 10. Thus, as a user moves to an upright position from a reclining position, the backrest 14 does not press significantly on the back of the user, even though the backrest 14 maintains full contact with user's back. In this way, there is a "dwell" in the recline of the chair 10 such that it tends to maintain its position for a short period of time as the user returns to an upright position, thus preventing the feeling of being ejected from the chair 10. Thereby, the chair tilt is "seat driven" rather than "backrest driven."

Additionally, some degree of potential energy is stored in the tilt spring 58 as a result of the initial downward movement of the seat 12 caused by the weight of the user when he or she sits down in the chair 10. This potential energy is released (as the tilt spring 58 unwinds), and actually assists the user when he or she makes an effort to get up out of the chair 10. Consequently, the chair 10 is more comfortable to both sit in and to arise from. In conventional chairs, in which pushing back against the backrest activates the tilt spring, (i.e. backrest driven) the only "assistance" when arising from the chair is in the form of the backrest pushing against the person's back, which is of no aid at all in standing to an upright position out of the chair. Rather, the backrest pushing against a user's back, either while seated or when arising, is an uncomfortable and unwelcome condition.

The parallel arm arrangements 30, 32 connecting the seat 12 and backrest 14 to the tilt control housing 16 can be designed such that there is a 1.2 to 1 ratio between the tilt of the seat 12 and the tilt of the backrest 14. As the chair 10 is tilted, the rear portion of the seat 12 moves downward relative to the front portion of the seat 12, and the seat 12 back tilts back therewith. Since the tilt of the seat 12 is a function of the user's weight, the tilt is much smoother and more controlled. Also, because the weight of the user is what causes the seat 12 to tilt, there is a gravity assist in the tilting of the chair 10, such that the user does not have to exert a substantial force on the backrest 14 of the chair 10 in order to recline comfortably.

The aforesaid tension adjustment knob 38 is provided in order to increase or decrease the initial tension on the tilt spring 58, i.e., adjust the preload on the tilt spring 58. In order to make it harder or easier (depending upon the weight of the user) for a user to tilt the seat 12 and backrest 14, the user rotates the tensioning knob 38 to either increase or decrease the tension on the tilt spring 58.

As can be seen best in FIG. 10, the aforesaid rotatable tensioning knob 38 is connected to a tensioning device connected to the tilt spring 58. As shown in the figures, the tensioning knob 38 is located below the tilt control housing 16 for convenient manual manipulation thereof by the user.

The tensioning control device is connected to the end of a threaded rod 90 which extends from the tensioning knob 38 and is captured within the tilt control housing 16. The end of the threaded rod 90 cooperates with a nut 92, and washers 94, which operatively engage the threaded rod 90 with the outer rigid outer surface 60 of the tilt spring 58. A retaining pin 96 can insure the nut 92 is never completely removed from the end of the threaded rod 90. In the embodiment shown, a cantilever arm 98, which can be formed integrally with the rigid outer surface 60 of the tilt spring 58, extends outwardly from the surface 60. Rotation of the tensioning knob 38, for example clockwise, causes the nut 92 to be drawn toward the knob 38, and the nut 92 draws the cantilever arm 98 downwards along with it, thus rotating the tilt spring 58 and thereby increasing the tension in the spring 58, making it harder to further compress the tilt spring 58, and thus also making tilting of the seat 12 and backrest 14 more difficult, and slower. Rotating the tensioning knob 38 in the opposite direction permits the tilt spring 58 to return to the initial position, or even beyond the initial setting, thereby reducing the tension, thus making it easier to tilt the seat 12 and backrest 14. Accordingly, by adjusting the tensioning knob 38, the tilt spring 58 can be pretensioned to adjust the degree, and/or ease, of tilting of the seat 12 and backrest 14 portion when a user leans back on the backrest. Since the tilt spring 58 is also connected to seat 12 via the drive shaft 46 connections to the drive links 52, the seat 12, and the backrest 14 because it is connected to the seat 12, will tilt either more or less depending on the user's weight on the seat. In this manner, the tilt is "seat driven."

Further in regard to the tensioning adjustment, the smaller moment arm resulting from utilizing a parallel arm linkage to rotatably connect the seat 12 to the torsion spring, which enables utilization of a lower rate of tilt spring 58, also enhances the functioning of the tensioning adjustment knob 38. Specifically, because the tilt spring 58 can have lower spring rate, the adjustment of the tensioning knob 38 is much easier, as compared to conventional tilt adjustment mechanisms wherein a heavier rate tilt spring is required, for the simple reason that it is easier to increase the tension on a lighter rate spring than on a heavier rate spring.

Generally, the reason that a heavier rate tilt spring is typically required is that conventional tilting chairs attach the tilt spring to the backrest, not the seat, which results in a longer moment arm, due to the larger distance between the connection to the backrest and the connection to the tilt spring (which is conventionally positioned just under the seat of the chair). The significantly longer moment arm in conventional chairs necessitates a higher rate of tilt spring, because the force exerted on the spring is a function of the load applied at the end of the moment arm and the length of the moment arm. Consequently, the tensioning adjustment for such a higher rate tilt spring requires correspondingly greater force to rotate the tensioning knob to preload the spring. One way to reduce the higher force required to rotate the tensioning knob would be to use a longer cantilever arm extending from the tilt spring. However, a longer cantilever arm can require a larger tilt control housing. Therefore, as can be understood, a significant advantage derives from activating the tilt spring by the seat of the chair instead of the backrest, thereby enabling a much shorter moment arm and thus a lower rate tilt spring.

As a convenience for the user, the tilt housing may have markings, or other indicators, that cooperate with a marker 40 on the tensioning knob 38 to indicate different settings corresponding to different weights of users. The user can use the weight setting approximating his or her weight to quickly and easily rotate the tilt tensioning knob 38 to the appropriate setting. Alternatively, the user can set the tension to a lighter weight, to have the seat 12 recline more quickly; or to a higher weight, to have the seat 12 recline more slowly, according to the user's preference. For example, a person weighing 175 pounds can set the knob 38 to the 175 pound setting, or can set it to a higher or lower weight to make the tilting harder or easier, respectively. Moreover, the full tilt of the seat 12 can be limited according to the position of the tilt lever 41.

Also operatively connected to the drive shaft 46 is a tilt lever 41. When pulled outwardly, the tilt lever 41 can limit, or set, the degree of tilt to which the chair 10 seat 12 and back will recline. The tilt lever 41 is pulled outwardly to release the limiting device.

As best viewed in FIG. 10, the tilt lever 41 is provided on, for example, the left side of the tilt control housing 16, as illustrated, and includes rod end 42 which is captured within the tilt control housing 16 and cooperates with a tilt locking assembly therein. The tilt locking assembly 104 cooperates with a magnetic member 100 (and a detent/stop 108) which facilitates movement of the tilt lever 41 from a release position (where the tilt lever 41 is pulled outwardly from the tilt housing 16), at which tilting is permitted, to a locked position (where the tilt lever 41 pushed inwardly into the tilt housing 16) at which tilting is blocked. Pushing the tilt lever 41 inwardly activates the tilt locking assembly 104, which comprises a tilt limiter member 105 that blocks rotation of the hexagonal shaped follower shaft 48 when activated by the tilt lever 41. The tilt limiter member 105 is held in position within the tilt control housing 16, operatively adjacent the magnetic member 100 and detent 108, by inner 106 and outer 107 bushings. The detent 108 cooperates with the aforesaid magnetic member 100 as described below. The magnetic member 100 is positioned at or near a distal portion of the rod end 42 of the tilt lever 41. The detent 108 has spaced apart, opposing side walls 109, 110 and the magnetic member 100 has a portion 112 thereof which is operatively positioned between the opposing side walls 109, 110. The side walls 109, 110 are made from a material which is magnetically attractive, such that the magnetic member 100 will be drawn into contact to either of the side walls 109, 110 if the magnetic member 100 comes into close proximity thereto. When the tilt lever 41 is pushed inwardly to lock the hexagonal follower shaft 48, the magnetic member 100 is into close proximity to an inner most side wall 110 of the detent 108, which attracts the magnetic member 100 drawing it into contact with the side wall 109. At this position, the tilt lever 41 is moved fully to the locked position. The attraction of the magnetic member 100 to the detent 108 not only draws the tilt lever 41 fully inward to ensure full inward movement, but also creates an audible indication, i.e., a "click," when the magnetic member 100 makes contact with the side wall 109. This "click" serves to audibly notify the user that the tilt lever 41 has been moved fully to the locked position. Conversely, drawing the tilt lever 41 outwardly results in the magnetic member 100 coming into close proximity to opposite side wall 110 of the detent 108, which likewise draws magnetic member 100 into contact with the side wall 110, thus ensuring that the tilt lever 41 has moved fully outward to the release position. As above, contact between the magnetic member 100 and the side wall 110 also creates the audible "click" which indicates that the tilt lever 41 has indeed been fully moved to the released position at which tilting is permitted.

In order to provide for added comfort to the user, the backrest 14 preferably includes a lumbar support member. Referring to FIGS. 16-19, an embodiment of a lumbar support 200 for a chair 10 according to the invention is illustrated, comprising a front lumbar pad 202 for contacting the body of the user, and a rear lumbar frame 204 secured by magnetic members, e.g., magnets, to the lumbar pad. The front pad 202 and rear frame 204 are detachable, and preferably held in a cooperating relationship to each other on opposite sides of the backrest 14 fabric 28 by the magnets. Preferably, six magnets 206*a*-206*f* are included on the face of the rear lumbar frame 204 which are matched to six magnets 208*a*-208*f* on the rear side of the front lumbar pad 202 which mates with the face of the lumbar frame 204. In this manner, the mesh fabric of the backrest 14 is "captured" between the front pad 202 and rear frame 204 of the lumbar support 200. Since there is no permanent connection between the lumbar support 200 and the backrest 14, the lumbar support 200 is vertically (and horizontally) adjustable along substantially the entire surface of the backrest 14. Consequently, the lumbar support 200 is essentially infinitely adjustable according to the desires of the user, from lumbar to pelvic support. If desired, the user may readily move or adjust the lumbar support 200 by moving the front pad 202 and the rear frame 204 will follow because of the magnetic attachment therebetween.

Figure 18:
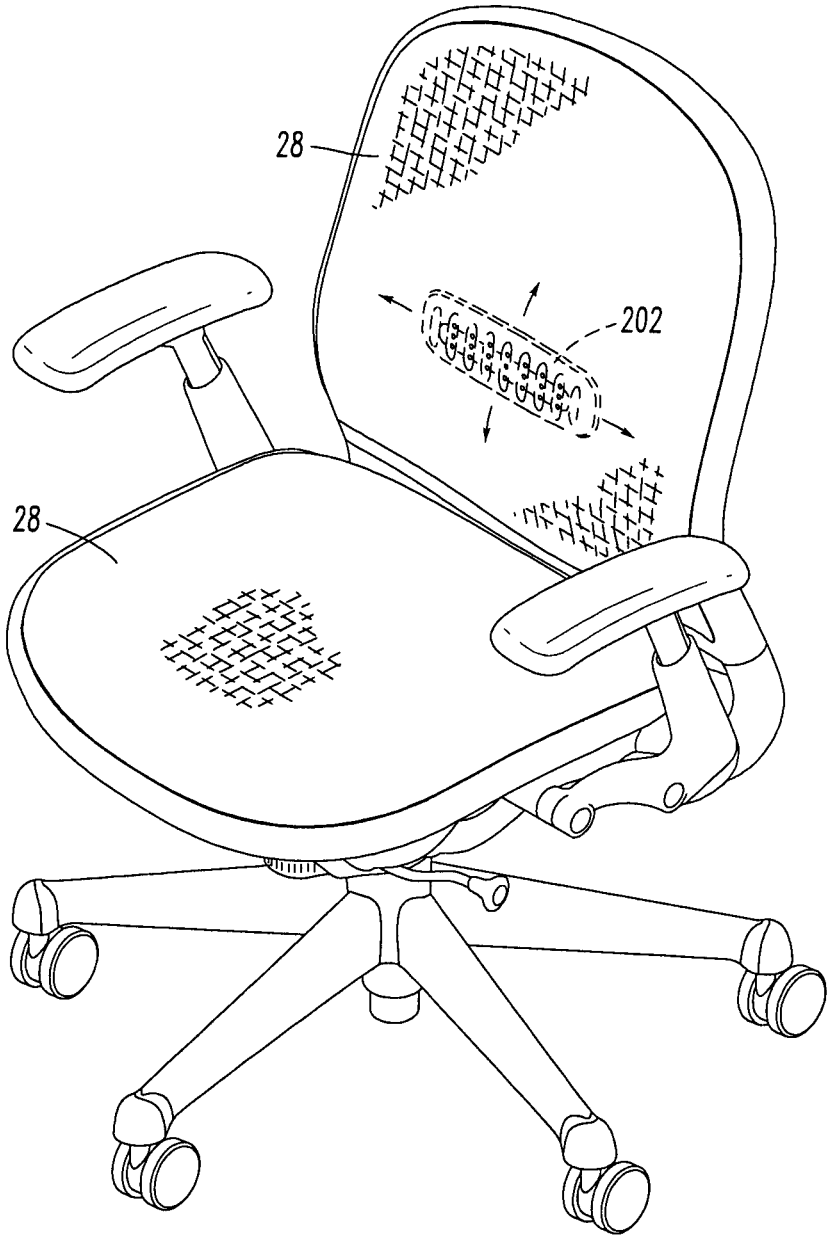
FIG. 18 is an isometric view of an office chair such as shown in FIG. 1 showing the front side of a lumbar support device such as shown in FIGS. 16 and 17.
Figure 19:
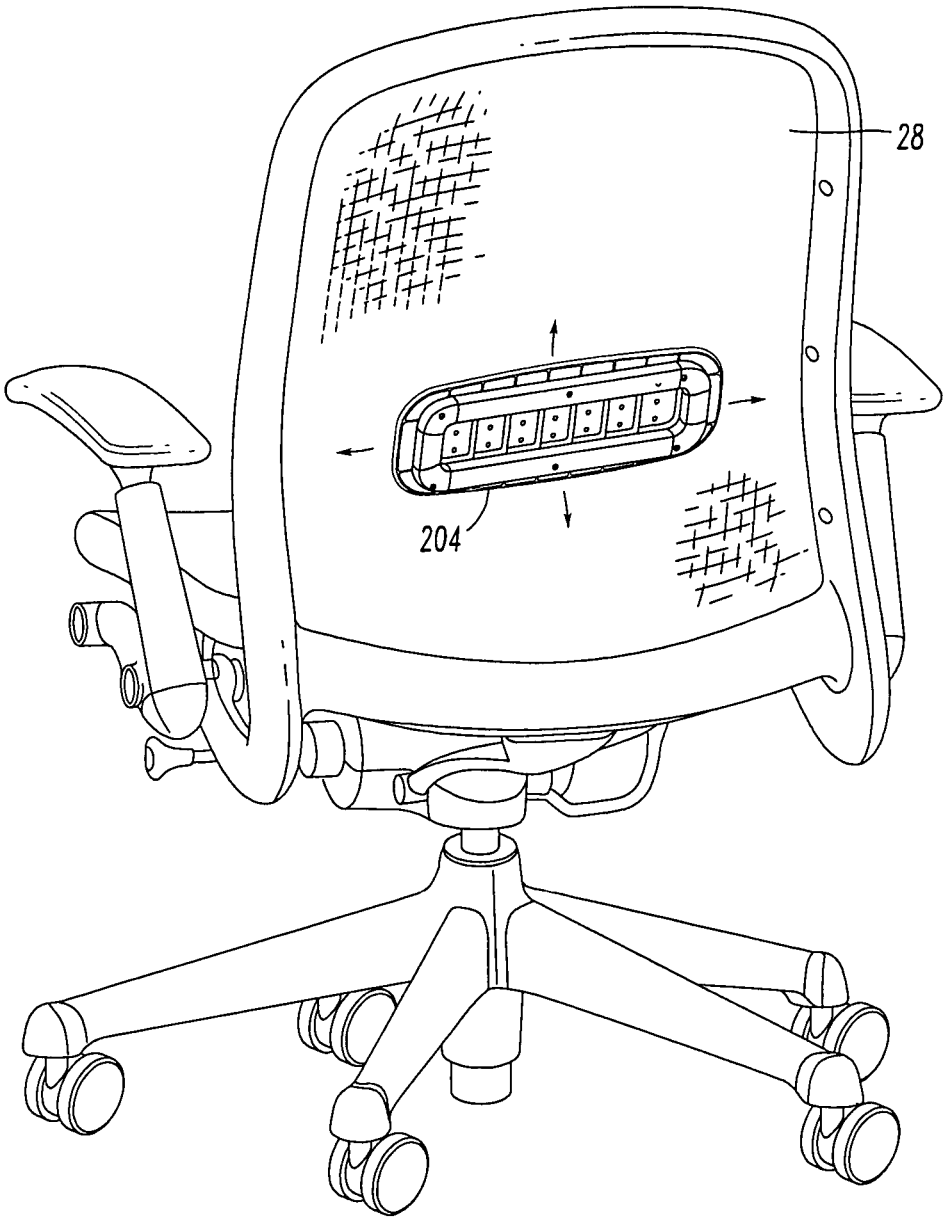
FIG. 19 is a isometric view of an office chair such as shown in FIG. 1 showing a rear side of the chair and lumbar support such as shown in FIGS. 16 and 17.

As shown in more detail in FIG. 18, the front lumbar pad 202 can be manufactured of injection molded plastic, and is slightly curved to generally match a users lumbar region. A facing surface, i.e., the front face of the lumbar pad 202 which contacts the user, is preferably made of a more comfortable material, such as a thermoplastic elastomer (TPE), gel or rubber, that is more pleasing to a user resting his or her back against the backrest 14 and the lumbar support 200. Both the facing surface of the front pad 202 and a back side thereof can be injection molded. In a preferred embodiment, the back side has a higher durometer than the facing surface, but is still able to flex. In this manner, as the user sits in the chair 10 and rests his or her back against the lumbar support 200, it flexes along with the mesh fabric 28 in order to more comfortably support the user. The back side of the front pad 202 which contacts the backrest 14 can have integrally molded magnet holding portions.

As described above, a mesh material 28 is preferably utilized for the seat 12 and backrest 14 material. However, it should be understood that the backrest 14 material could be formed from any type of appropriate, relatively thin material which would permit the cooperating magnetic members of the front pad 202 and rear frame 204 of the lumbar support 200 to be maintained in a cooperating relationship on each side of the material as the lumbar support 200 is adjusted.

Figure 20:
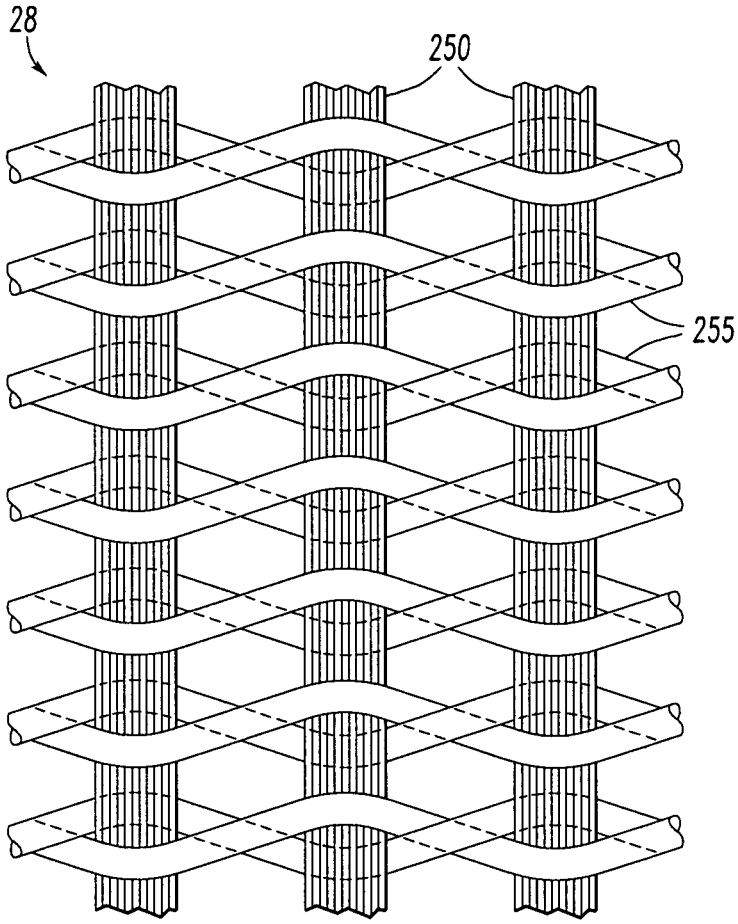
FIG. 20 is an enlarged view showing the structure of a mesh material which can be utilized for the chair set and backrest.

Preferably the seat 12 and backrest 14 are comprised of a frame having an elastic mesh fabric 28 attached thereto. Referring to FIG. 20, the mesh fabric 28 preferably comprises a plurality of different types of materials, such as multifilament yarn and monofilament fibers that provide an open weave pattern for the seat 12 and backrest 14. This can provide a more comfortable seating arrangement for the user, such that air is free to circulate about the chair 10 and the user's body. Each of the seat 12 and backrest 14 comprise a molded frame, preferably formed by injection molding or other conventional plastic molding techniques, as described hereinafter in more detail, with which the mesh fabric has been incorporated. As shown, the mesh fabric 28 includes an open weave pattern of multifilament yarn interwoven with monofilament elastomeric material disposed perpendicularly to the yarn in a conventional leno weave pattern. A leno weave is defined as one where adjacent warp fibers (i.e., monofilaments) are arranged in pairs with one twisted around the other between picks of filling yarn, effectively locking each pick in place. In the figure, the multifilament yarn 250 is vertically oriented while the monofilament material 255 comprises a pair of monofilament strands generally woven in a horizontal "over/under" pattern which twist between the multifilament strands. The fabric 28 thus made is significantly "stretchable" to a sufficiently taut condition so as to provide a firm support for the body of the user.

Figure 21:
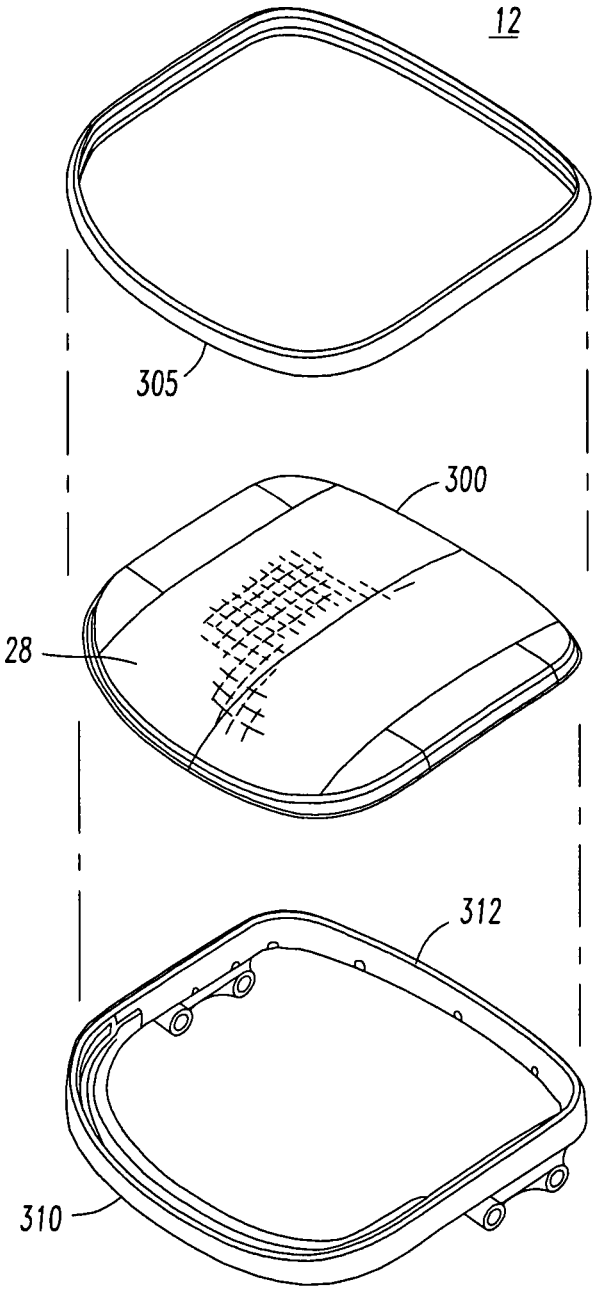
FIG. 21 is an exploded view of an embodiment of a chair seat such as for an office chair shown in FIG. 1.
Figure 22:
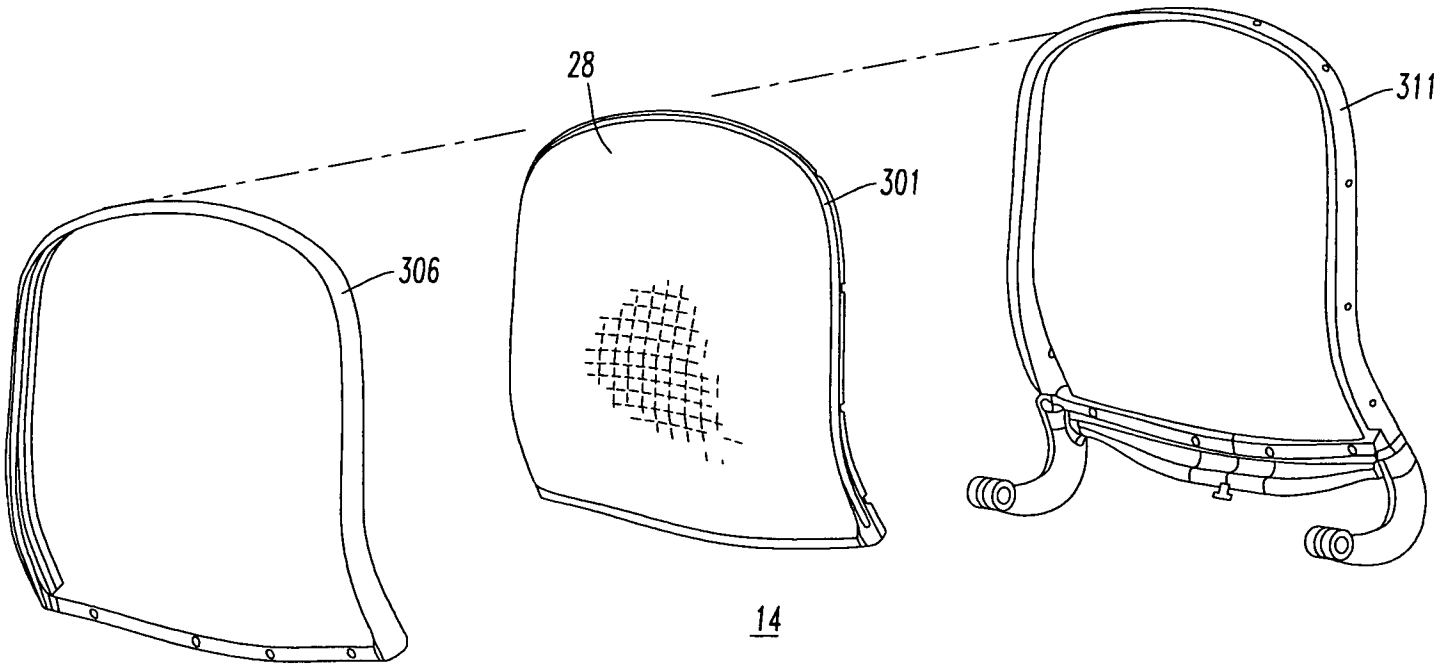
FIG. 22 is an exploded view of a backrest of an office chair such as shown in FIG. 1.
Figure 23:
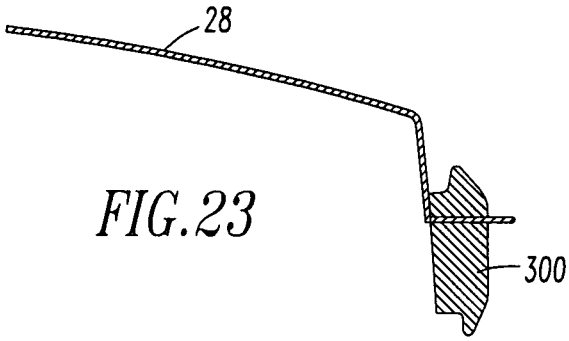
FIG. 23 is a partial cross sectional view of an embodiment of the seat fabric and a peripheral rim portion attached thereto.
Figure 24:
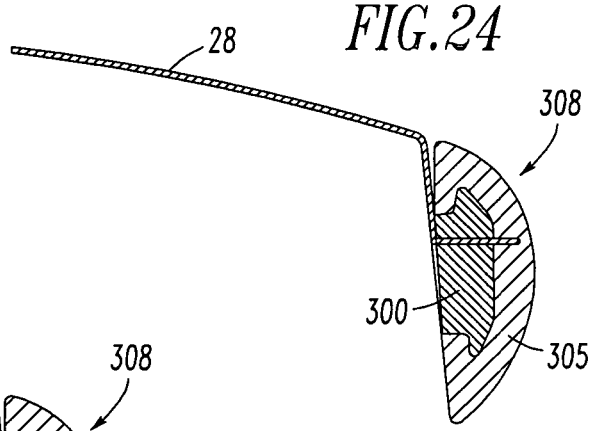
FIG. 24 is a partial cross section view as shown in FIG. 23 and further showing an over molded portion.
Figure 25:
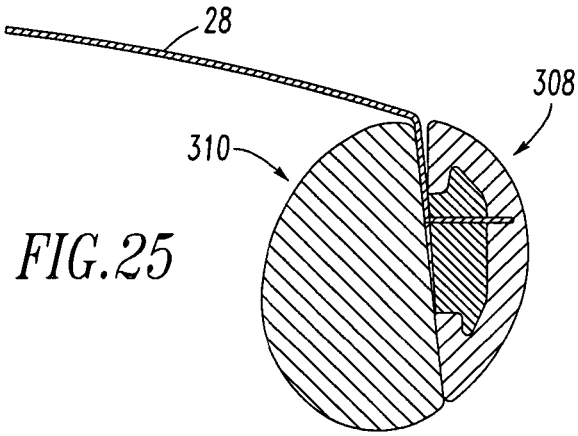
FIG. 25 is a cross sectional view showing the over molding illustrated in FIG. 24 as it might be attached to the frame of either the seat or the backrest according to an embodiment of the invention.
Figure 26:
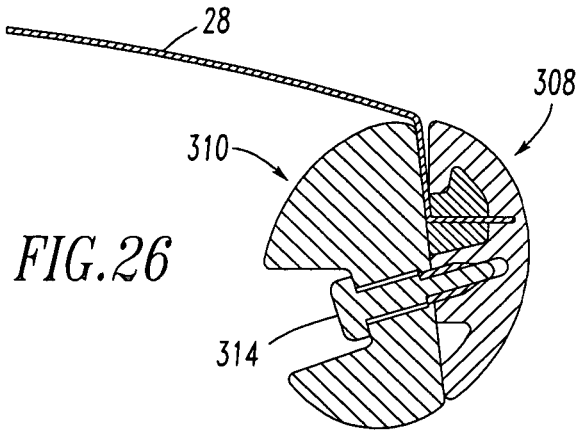
FIG. 26 is a cross sectional view as shown in FIG. 25, except taken at a section illustrating the manner in which the over molding can be attached to either the frame of the seat or the frame of the backrest according to the embodiment of the invention.

A presently preferred embodiment of the construction of the seat 12 and backrest 14 are illustrated in FIGS. 8 and 21-26. As shown in FIG. 8, the seat 12 generally comprises an inner frame 310 over which is attached an outer frame 308 using fasteners 314 to secure the two together. As shown in FIG. 21, the outer frame 308 is comprised of an overmolding 305 encapsulating a rim portion 300 to which the mesh fabric 28 has been attached. As shown in FIGS. 8 and 22, the backrest 14 is similarly formed of an outer frame 309 secured via fasteners 314 over an inner frame 311, wherein the outer frame 309 is likewise formed of an overmolding 306 encapsulating a rim portion 301 to which the mesh fabric 28 has been attached.

The seat 12 construction and manner of assembly will be described in detail hereinafter, and it is to be understood that the backrest 14 construction and manner of assembly is essentially identical to the seat 12 construction. As such, the backrest 14 construction is not otherwise described in detail hereinafter.

The inner frame 310 is the main structural component, and includes areas for securing the seat 12 to the tilt control housing 16. The outer frame 308 is preferably made integral with the mesh fabric, as described above, and in a manner that will be more fully described below. As the outer frame 308 is placed over the inner frame 310, in a manner similar to that of an embroidery hoop, the mesh fabric 28 is engaged by an upper edge 312 of the inner frame 310. As the outer frame 308 is positioned down over the inner frame 310, the perimeter of the mesh fabric 28 is pulled downward over the upper edge of the inner frame 310, causing the mesh fabric 28 to become tensioned to a desired degree necessary to provide support for a user sitting in the chair 10. The inner frame 310 is then secured in position to the outer frame 308 by a plurality of fasteners, such as mechanical screws or the like, which, for example, pass through pilot holes intermittently molded about the inner frame 310 and threadingly engage screw holes in the outer frame 308, as shown best in FIG. 26. This locks the inner frame 310 and outer frame 308 together, maintaining the mesh fabric 28 in a taut condition. It will be understood by those skilled in the art that other fastening means may be used to lock the inner 310 and outer 308 frames together. For example, electro-bonding and/or chemical bonding techniques, well known in the art, may be used. In a preferred embodiment, both the inner 310 and outer 308 frames have planar mating surfaces for facilitating the connection of the two pieces.

Referring to FIGS. 21-26, the stages of construction of the outer frames 308, 309 of the seat 12 and backrest 14, respectively, are illustrated, according to a presently preferred embodiment of the invention. In particular, regarding the seat, the stretchable mesh fabric 28 is initially made integral with a rim portion 300, at which stage the mesh fabric 28 is in a generally relaxed, or unstretched, condition. To attach the rim portion 300, relaxed mesh fabric 28 is held in a jig and is placed in an injection molding machine in which the rim portion 300 is injected about the periphery of the mesh fabric 28 in the desired shape of the seat 12. The rim portion 300 is preferably made of a copolyester elastomer or polypropylene material and is injection molded to the perimeter of the mesh fabric 28. The material for the rim portion 300 is selected such that the temperature required to melt the material, and thus employed in the injection molding technique, is not otherwise destructive to the mesh fabric 28. Preferably, this temperature does not exceed about 200° C. This forms a permanent bond between the rim portion 300 material and the stretchable mesh fabric 28. An outer perimeter of the mesh fabric 28, which may extend externally of the rim portion 300, can either be trimmed off or left intact during the final manufacture of the outer frame 308.

As shown in the figures, the outer frame 308 is substantially rigid, and is finally constructed by overmolding a rigid material of exceptional mass and geometry continuously about the perimeter of the mesh fabric 28 and enclosing the rim portion 300, to create a composite outer frame assembly 308 that is not susceptible to expansion or deformation during the frame construction. Preferably, the overmolding material comprises glass filled or non-glass nylon or neoprene or polypropylene, which is injection molded over the rim portion 300 at a temperature which does not exceed about 220° C. This temperature is selected to avoid any appreciable melting of the rim portion 300 during the overmolding process. Since the overmolding does not touch the mesh fabric 28 beyond the rim portion 300, there is no danger of damage to the mesh fabric 28.

The outer frame 309 of the backrest 14 is manufactured in exactly the same manner as that for the outer frame 308 of the seat 12 as just described. Thus, both the seat 12 and backrest 14 comprise a structural inner frame 310, 311 having a cross section of continuous perimeter. The outer frames 308, 309 of both the seat 12 and the backrest 14 likewise have a cross section of continuous perimeter. The shape of the inner 310, 311 and outer 308, 309 frames are preferably complimentary, and can be configured in the injection molding process to any contour. For example, the front of the seat frame may curve downwardly to provide added comfort to the user's thighs while sitting the chair. In addition, a resilient insert, or pad 317, is also preferably provided at the forward edge of the seat frame, between the mesh fabric and the inner frame. This pad further relieves any pressure on the user's legs at the edge of the seat, which greatly improves the comfort of the seat.

Similarly, the backrest 14 may be contoured so as to provide lumbar support for the lower back of the user, as well as for the upper portion of the back near the users shoulders. In whatever shape the seat 12 and backrest 14 are configured, the mesh fabric 28 is stretched from a relaxed condition prior to assembly, to a final stretched condition wherein the fabric 28 is captured between the inner 310, 311 and outer 308, 309 frames, and in which condition the fabric 28 is sufficiently taut to adequately and comfortably support the weight of the user.

The design described above results in the exterior surface of the outer frames 308, 309 defining an exterior surface of the frame of the seat and the backrest, such that a cleaner, more aesthetic exterior surface of the seat and backrest frames is achieved. In some chair designs which utilize a mesh fabric for the backrest and seat supports, the mesh portion is attached to a carrier portion which is then inserted into a channel formed in an exterior surface of the seat and backrest frame members, such that the two seams of the channels which receive the carrier inserts are clearly visible. This can create a less aesthetically appealing chair exterior. In the present manner of attachment, only a single seam between the outer 308, 309 and inner 310, 311 frames is created, which is also only visible from either below the chair or from behind. As can be seen in the drawing figures, the top, front and side views of the chair 10 do not reveal any visible seam between the outer frames 308, 309 and the inner frames 310, 311, giving a cleaner, smoother appearance. Only from the bottom and back view can the single seam between the inner and outer frames be seen.

As is conventional in such chairs 10, a height adjustment mechanism for the vertical column is preferably provided. Referring to FIGS. 9 and 10, just rearward of the tilt spring 58 there can be seen a tubular receptacle 320 in the tilt control housing 16. In this tubular receptacle 320 is received an upper end portion of the vertically adjustable column 20 which generally connects the base 18 to the tilt control housing 16. Adjacent the tubular receptacle 320 is provided a height adjustment actuator 322 which cooperates with the upper end of the vertical column 20 to activate the vertical adjustment of the adjustable column 20. The vertical column 20 can be an adjustable column, such as a conventional gas operated piston/cylinder. The actuator 322 can be pivotably pinned at a base portion thereof via a pair of retainers 324, 325. A distal portion of the actuator 322 overlay somewhat the tubular receptacle 320 and cooperates with the upper end of the vertical column 20 to effect vertical adjustment thereof. The vertical adjustment control rod 44 has a rod end 45 which is captured in the tilt control housing 16 and is operatively associated with the actuator 322 to cause pivoting thereof to cause the vertical adjustment actuator 322 to pivot about the pinned end such that the distal portion of the actuator 322 activates the vertically adjustable column 20 to permit the seat 12 height to be raised or lowered. A resilient member 326 can also be provided intermediate the rigid outer surface 60 of the tilt spring 58 and the vertical adjustment actuator 322, wherein the resilient member 326 can bias the height adjustment actuator 322 towards a position at which vertical adjustment of the vertical adjustable column 20 deactivated, such that the height of the vertical column 20 cannot be adjusted. The opposite end of the vertical adjustment control rod is a handle configured for easy manual manipulation thereof to move the height adjustment actuator 322 to a second position wherein vertical adjustment of the vertically adjustable column 20 is enabled. Preferably, an upward movement of the handle permits the vertically adjustable column 20 to be raised or lowered, and releasing the handle results in the resilient member 326 automatically biasing the height adjustment actuator 322 back to a position where vertical adjustment of the column 20 is deactivated.

There is described herein is a multi-functional and positionable office or task chair 10 which can accommodate users of varying shapes and sizes in a variety of ways.

Although specific embodiments of the invention are shown in the drawings and described in detail herein, it will be appreciated by those skilled in the art that various modifications and alternatives could be developed in light of the overall teachings of the disclosure. Accordingly, the particular embodiments disclosed herein are meant to be illustrative only, and not limiting to the scope of the invention, which is to be given the full breadth of the appended claims and any and all equivalents thereof.

What is claimed is:

1. A chair comprising a base, a seat supported by said base, a tilt mechanism connected to said base, a backrest connected to at least one of said seat, said base and said tilt mechanism, said tilt mechanism comprising at least one magnetic portion, said tilt mechanism connected to said base such that movement of said seat activates said tilt mechanism resulting in tilting at least one of said seat and said backrest.

2. The chair of claim 1 further comprising said seat connected to said tilt mechanism wherein application of weight to said seat causes said tilt mechanism to tilt at least one of said seat and said backrest.

3. The chair of claim 2 wherein said chair is further comprised of a plurality of links connected to said tilt mechanism and said tilt mechanism is further comprised of a tilt spring, said plurality of links further comprising first and second pairs of parallel arms rotatably connecting opposite sides of said seat to said tilt mechanism such that said seat rotates about said tilt mechanism in a first path defined by said first and second pairs of parallel arms, and wherein at least one of said first and second pairs of parallel arms are connected to said tilt spring such that said tilt spring is activated in response to movement of said seat.

4. The chair of claim 3 wherein said backrest is rotatably connected to said seat at seat connection points of one of said first and second pairs of parallel arms.

5. The chair of claim 2 wherein at least one of said seat and backrest are at least partially tilted forward when the chair is in an upright position.

6. The chair of claim 2 further comprising a plurality of links connected to said base, an armrest connected to a first side of said base and a second armrest connected to a second side of said base, said plurality of links further comprising first and second pairs of parallel arms rotatably connecting first and second sides of said seat to said base at respective pivot points, wherein said first armrest is connected to at least one of said respective pivot points adjacent the first side of the base and said second armrest is connected to at least one of said respective pivot points adjacent the second side of the base.

7. The chair of claim 1 further comprising said backrest rotatably connected to said base and a link rotatably connecting said backrest to said tilt mechanism such that said backrest rotates relative to said tilt mechanism in a path defined by said link and at least one connection of said backrest to at least one of said base, said tilt mechanism and said seat.

8. The chair of claim 7 wherein said link is a Y-shaped link rotatably connected at two locations on said tilt mechanism and pivotably connected at one location on said backrest.

9. The chair of claim 1 further comprising:

at least one of said seat and said backrest formed from a flexible mesh material;

said flexible mesh material having a perimeter portion thereof attached to a substantially rigid outer frame portion of at least one of said seat and said backrest;

said outer frame portion attachable to a mating inner frame portion of at least one of said seat and said backrest;

said flexible mesh material stretchable from a first relaxed condition to a final stretched condition as said outer frame portion is attached to said inner frame portion;

said outer frame portion having an outer surface which forms an outer surface of at least one of said seat and said backrest when attached to said inner frame portion; and said inner frame portion hidden by said outer frame portion when attached thereto.

10. The chair of claim 1 wherein the at least one magnetic portion is comprised of at least one magnetic apparatus comprised of a material that is magnetically attractive that is selected from the group consisting of magnetic members and magnets.

11. A chair comprising a base;

a seat supported by said base;

a tilt mechanism intermediate said seat and said base;

a backrest connected to at least one of said seat, said base and said tilt mechanism;

said tilt mechanism connected to said base such that movement of said seat activates a tilt spring resulting in tilting at least one of said seat and said backrest; and a tilt limiter which is movable between a first position at which tilting is enabled and a second position at which tilting is prevented, said tilt limiter having at least one magnetic portion which facilitates movement of said tilt limiter to at least one of said first and second positions.

12. The chair of claim 11 wherein said tilt limiter creates an audible indication that is audible to a seated user of the chair, the audible indication indicating that said tilt limiter has moved to at least one of said first and second positions.

13. The chair of claim 12 wherein said at least one magnetic portion facilitates creating said audible indication that said tilt limiter has moved to at least one of said first and second positions.

14. The chair of claim 13 wherein at least one of said seat and said backrest further comprises a flexible mesh material.

15. The chair of claim 11 wherein the at least one magnetic portion is comprised of at least one magnetic apparatus comprised of a material that is magnetically attractive that is selected from the group consisting of magnetic members and magnets.

16. A chair comprising a base;

a seat supported by said base;

a tilt mechanism intermediate said seat and said base;

a backrest connected to at least one of said seat, said base and said tilt mechanism, said backrest having a front side and a rear side;

a lumbar support comprising a front pad and a rear frame, said front pad positionable on said front side of said backrest and said rear frame positionable on said rear side of said backrest; and said lumbar support movable relative to said backrest as said front pad and said rear frame are maintained in a position relative to each other on opposite sides of said backrest by attractive forces between at least one magnetic member provided on a back of said front pad and at least one magnetic member provided on a front of said rear frame.

17. The chair of claim 16 wherein said backrest material comprises a flexible mesh material.

18. The chair of claim 16 wherein the at least one magnetic member provided on the back of said front pad is comprised of at least one magnetic apparatus composed of a material that is magnetically attractive.

19. A chair comprising a base, a seat supported by said base, a tilt mechanism connected to said base, a backrest connected to at least one of said seat, said base and said tilt mechanism, said tilt mechanism moveable from a first position to at least one second position, said tilt mechanism comprising at least one magnetic portion sized and configured to maintain said tilt mechanism in at least one of said first position and said at least one second position.

20. The chair of claim 19 wherein the at least one magnetic portion is comprised of at least one magnetic apparatus comprised of a material that is magnetically attractive that is selected from the group consisting of magnetic members and magnets.

* * * * *